US006330404B1

(12) United States Patent
Munenaka et al.

(10) Patent No.: US 6,330,404 B1
(45) Date of Patent: Dec. 11, 2001

(54) BELT, IMAGE FORMING APPARATUS WHICH EMPLOYS BELT, BELT REPLACING METHOD AND BELT CONTROL PROGRAM

(75) Inventors: Katsumi Munenaka, Kawasaki; Norio Matsui, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/482,906

(22) Filed: Jan. 14, 2000

(30) Foreign Application Priority Data

Jan. 14, 1999 (JP) ..... 11-008385
Apr. 13, 1999 (JP) ..... 11-105747
Jan. 12, 2000 (JP) ..... 12-003713

(51) Int. Cl.[7] ..... G03G 15/043; G03G 15/01
(52) U.S. Cl. ..... 399/51; 399/302; 399/303
(58) Field of Search ..... 399/303, 162, 399/313, 361, 51, 302, 308, 178

(56) References Cited

U.S. PATENT DOCUMENTS 4,972,208 * 11/1990 Young et al. .
6,038,423 * 3/2000 Tagawa et al. ..... 399/162 X

FOREIGN PATENT DOCUMENTS 60-97367 * 5/1985 (JP) .
2544631 7/1986 (JP) .
02-013976 1/1990 (JP) .

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes a plurality of image bearing members; image forming means for forming images of different colors on the image bearing members, respectively; a transfer material conveyer belt for carrying a transfer material; a driving roller for transmitting a driving force to the transfer material conveyer belt; wherein the images of different colors formed on the image bearing members are sequentially transferred in an overlying manner onto the transfer material carried on the transfer material conveyer belt; storing means for storing information on thicknesses of the transfer material conveyer belt at different positions in a movement direction thereof; detecting means for detecting a predetermined position of the transfer material conveyer belt; and control means for controlling timing of start of image formation for each of the image bearing members by associated one of the image forming means on the basis of the information stored in the storing means and a result of detection by the detecting means.

81 Claims, 16 Drawing Sheets

| BLOCK | T (μ) |
|---|---|
| 1 | H1 |
| 2 | H2 |
| 3 | H3 |
| 4 | H4 |
| 5 | H5 |
| 6 | H6 |
| 7 | H7 |
| 8 | H8 |

| Δ | INTEGRATED Δ | Y | M | C | Bk |
|---|---|---|---|---|---|
| C1 | D1 | Y×1 | M×1 | C×1 | K×1 |
| C2 | D2 | Y×2 | M×2 | C×2 | K×2 |
| C3 | D3 | Y×3 | M×3 | C×3 | K×3 |
| C4 | D4 | Y×4 | M×4 | C×4 | K×4 |
| C5 | D5 | Y×5 | M×5 | C×5 | K×5 |
| C6 | D6 | Y×6 | M×6 | C×6 | K×6 |
| C7 | D7 | Y×7 | M×7 | C×7 | K×7 |
| C8 | D8 | Y×8 | M×8 | C×8 | K×8 |

REFERENCE : Y

| BLOCK | M CRCTN | C CRCTN | Bk CRCTN |
|---|---|---|---|
| 1 | Me1 | Ce1 | Ke1 |
| 2 | Me2 | Ce2 | Ke2 |
| 3 | Me3 | Ce3 | Ke3 |
| 4 | Me4 | Ce4 | Ke4 |
| 5 | Me5 | Ce5 | Ke5 |
| 6 | Me6 | Ce6 | Ke6 |
| 7 | Me7 | Ce7 | Ke7 |
| 8 | Me8 | Ce8 | Ke8 |

TIME

REFERENCE : Y

| BLOCK | M CRCTN | C CRCTN | Bk CRCTN |
|---|---|---|---|
| 1 | Mt1 | Ct1 | Kt1 |
| 2 | Mt2 | Ct2 | Kt2 |
| 3 | Mt3 | Ct3 | Kt3 |
| 4 | Mt4 | Ct4 | Kt4 |
| 5 | Mt5 | Ct5 | Kt5 |
| 6 | Mt6 | Ct6 | Kt6 |
| 7 | Mt7 | Ct7 | Kt7 |
| 8 | Mt8 | Ct8 | Kt8 |

FIG. 11

BELT, IMAGE FORMING APPARATUS WHICH EMPLOYS BELT, BELT REPLACING METHOD AND BELT CONTROL PROGRAM

FIELD OF THE INVENTION AND RELATED ART

The present invention relates to an image forming apparatus, for example, a copying machine, a printer, a facsimile machine, or the like, which employs an electrophotographic system.

Usually, an image forming apparatus which employs an electrophotographic process comprises: an image formation station in which a latent image is formed with the use of light, magnesium, electric charge, or the like, and a visible image is formed by developing the thus formed latent image; a means for conveying to the image formation station a piece of transfer medium onto which the visible image formed in the image forming station is transferred; and a fixing means for fixing the image having been transferred onto the transfer medium, to the transfer medium.

Each image formation station comprises an image formation medium, a latent image forming means, and a developing means. The image formation medium may be an electrophotographic photosensitive member (image bearing member), or may be different from the electrophotographic photosensitive member in property and shape. The latent image forming means and developing means varies depending on the property and shape of the employed photosensitive drums As for a means for conveying the transfer medium from the transferring means for transferring an image onto the transferring medium, to the fixing means in a color image forming apparatus, in particular, a color image forming apparatus in which a full-color image is formed by placing in layers a plurality of images formed with the use of a plurality of image formations stations, on a piece of transfer medium, a conveying means which conveys the transfer medium by electrostatically adhering the transfer medium to its surface is widely used because of its superior conveying performance.

The image forming apparatus disclosed by the applicants of the present invention in Japanese Laid-Open Patent Application No. 13976/1990 may be listed a one of the well-known image forming apparatus of the above described type. FIG. 17 schematically depicts the image forming apparatus disclosed in the aforementioned official gazette.

Referring to FIG. 17, the image forming apparatus comprises; three image formation stations I, II and III; a conveying means 139 provided with a conveyer belt 126 for conveying transfer medium; and a fixing apparatus 56 provided with a pair of thermal rollers 56*a* and 56*b* for fixing the image on the transfer medium to the transfer medium. The conveying means 139 is located below the image formation stations I, II and III, and the fixing apparatus 56 is located at the downstream end of the conveying means 139 in terms of the direction in which the transfer medium is conveyed. The image formation stations I, II and III comprise photosensitive drums 111, 112 and 113, charging devices 114, 115 and 116, developing devices 117, 118 and 119, transfer charging devices 120, 121 and 122, and cleaner 123, 124 and 125, correspondingly.

The conveyer belt 126 is formed of resin. In order to assure that the transfer medium is reliably conveyed, the surface of the conveyer belt 126 is charged with the use of a charging device 133 for adhesion, during the image forming operation, so that the transfer medium is electrostatically adhered to the conveyer belt 126.

A conveyer belt 126 is suspended by a driver roller 131 as a rotational member, and a follower roller 134, being stretched with the application of a predetermined amount of tension. The conveyer belt 126 runs at a predetermined conveyance velocity as the driver roller 131 in rotationally driven.

The transfer medium T sent out by the registration roller 49 onto the conveyer belt 126 is electrostatically adhered to the conveyer belt 126. In order to further assure that the transfer medium T is properly, that is. without becoming wavy, adhered to the conveyer belt 126, the recording medium is pressed onto the conveyer belt 126 by the follower roller 134 of the transfer medium conveying means 139, and a presser roller 52 disposed in contact with the follower roller 134, as the recording medium T is passed between the follower roller 134 and presser roller 52.

In order to prevent the placement of the recording medium T upon the conveyer belt 126 from being affected by the conveyance velocity of the registration roller 49, the conveyance velocity of the registration roller 49 is set at a slightly greater velocity than that of the conveyer belt 126 so that the transfer medium T is bent in the form of an arc between the registration roller 49 and presser roller 52.

In a high temperature-high humidity environment, the conveyer belt 126 fails to be sufficiently charged. and therefore, the transfer medium T sometimes separates, or floats, from the conveyer belt 126. As the recording medium T flosts, problems occur; for example, an image becomes misaligned with the recording medium T as the former is transferred onto the latter (transfer misalignment, registration misalignment), or certain portions of an image fail to be transferred onto the recording medium T. In order to deal with such problems, an auxiliary roller 200 and an idler roller 203 are provided, which are positioned on the outward and inward sides, respectively, of the conveyer belt loop, in a manner to pinch the conveyer belt 126.

One of the essential factors which determine the quality of a color image is the alignment among the plurality of monochrome images which form a color image. If the plurality of monochrome images of different color are misaligned in the secondary and/or primary scanning directions, or are not parallel to each other, color misregistration occurs.

In the case of an image forming apparatus such as the one described above, in which each of a plurality of monochromatic images of different color which form a color image is formed at a location different from the locations where other images are formed, the color deviation is more liable to occur, compared to a conventional apparatus in which all the monochromatic images of different color are formed and transferred at the same location.

Paying attention to the color deviation related to the direction of the secondary scanning, there are static and dynamic causes for this type of color deviation. As for the static causes, it is possible to list the difference in the distance between the adjacent two drums, misalignment in exposure position, diameter of a driver roller which determines the velocity at which the transfer medium is conveyed during image transfer. These causes mainly result from assembly errors and impreciseness of components As for the dynamic causes, it is possible to list the fluctuation in the rotational velocities of the image bearing members, and/or belt.

Among the above listed causes for the color deviation, the dynamic causes are generally difficult to rectify. In order to rectify the dynamic causes, the fluctuation in the rotational velocities of the image bearing members and belt must be reduced as much as possible. Therefore, the driving power sources have been devised in various ways in accuracy and control method. For example, the length of each image formation station in terms of the circumferential direction of the belt was set to be equal to a value obtained by multiplying the circumference of the driver roller by an integer so that the eccentricity of the driver roller did not result in the color deviation.

As for the main cause of the aforementioned fluctuation in the rotational velocity of the belt, it is possible to list the nonuniformity in the thickness of the belt.

In the past, the transfer medium conveyer belt, intermediary transfer belt, photosensitive belt, and the like, in other words, the member in the form of an endless belt, were produced by connecting one end of a sheet of belt material to the other end. Thus, these members had a seam, on which an image cannot be formed. Therefore, recently, in order to improve image formation efficiency, the members in the form of an endless belt with a seam have been gradually replaced by members in the form of a seamless and endless belt. Such a seamless and endless belt is produced by centrifugal molding, for example; solution of belt material is cast and wintered in a rotating metallic mold. However, when this molding method is used to produce a seamless and endless belt, the thickness of the belt is liable to become nonuniform in terms of the circumferential direction due to the limitation in the production method. This nonuniformity in the circumferential direction of the belt does not manifest as numerous alternations of thick and thin portions Instead, the nonuniformity usually manifests in the form of sine waves, in terms of the circumferential direction of the belt.

When a seamless belt was used in the aforementioned conventional image forming apparatus, the transfer medium was simply conveyed by the seamless belt, being adhered thereto, and images were formed and transferred onto the transfer medium by the image formation stations I, II and III.

The conveyance velocity of the conveyer belt 126 at any given moment is determined by the diameter of the driver roller 131, and the thickness of the conveyer belt 126, across the portion in contact with the driver roller 131 at that moment. In other words, when the diameter of the driver roller 131 is D; the average thickness of the conveyer belt 126 is d; and the number of revolution of the driver roller 131 is N, the conveyance velocity of the conveyer belt 126 is $(D+d)\times N$, wherein $(D+d)$ is the diameter of the pitch circle.

Assuming that the thickness of the belt is not uniform, varying within a range of $(d-\delta)$ to $(d+\delta)$, the maximum value of the conveyance velocity of the belt is $(D+d+\delta)\times N$, and the minimum value of the conveyance velocity of the belt is $(D+d-\delta)\times N$. Thus, the conveyance velocity of the conveyer belt 126 slowly fluctuates between these two values as the belt runs its loop (length of the belt is assumed to be L).

This subject will be elaborated referring also to FIG. 17.

The time at which an image is formed in the image formation station II is a predetermined length of time after an image formed by an image formation station I is transferred onto the transfer medium T, and the same is true in the image formation station III. More specifically, the length of delays are $(L_{2-1})/(D+d)\times N$ for the image formation station II, and $(L_{3-1})/(D+d)\times N$ for the image formation station III, assuming that the distances from the image formation station I to the image formation stations II and III are $L_{2-1}$ and $L_{3-1}$, respectively, and the average velocity of the conveyer belt 126 is $(D+d)\times N$.

However, for the aforementioned reason, the conveyance velocity of the conveyer belt 126 fluctuates within the range the center of which is the average conveyance velocity of the conveyer belt 126. Therefore, depending on the rotational phase of the conveyer belt 126, the images formed in the image formation stations II and III tend to be transferred onto the recording medium T, on the upstream or downstream side of the image formed on the conveyer belt 126 in the image formation station I, in terms of the moving direction of the conveyer belt 126, resulting in the color deviation which reduces the quality of the final image.

The above described misalignment among the images formed in the different image formation stations, which is caused by the fluctuation in the conveyance velocity of the conveyer belt 126 is schematically shown in FIG. 18.

In FIG. 18, that is, a graph, the axis of abscissas represents time (t), and the axis of ordinates represents the amount of the fluctuation V in the velocity of the conveyer belt 126. The bidirectional arrows, which are located on the top side of the graph and are designated with lower-case letters $y_1$-$c_1$, represent the exposure timings for the photosensitive drums 111 and 113, whereas the bidirectional arrows, which are on the bottom side of the graph and are designated with uppercase letters $L_1$-$C_1$, and the stem portions of which are modified with short, crossing lines, represent the way each of the toner images which result from the development of the latent images formed by the exposures are transferred onto the first transfer medium T The subscript numbers 2, 3 and so on, correspond to the following image formations. The image formation may be carried out for a single piece of transfer medium T, or may be repeatedly carried out up to a subscript letter n.

As depicted by FIG. 18, the misalignment among the toner images Y–C, which results from the fluctuation v in the velocity of the conveyer belt 126, occurs on each of the transfer media $T_1$, $T_2$, . . . $T_n$. Further, the position of each of the toner images of different color becomes different among the plural sheets of transfer medium, for example, between the transfer media $T_1$ and $T_2$, or between transfer media $T_2$ and $T_n$.

In FIG. 8. the small alternating fluctuation V in the velocity of the conveyer belt, similar to the fluctuation of alternating current, which is depicted by the solid line, corresponds to the fluctuation V in the peripheral velocity of the driver roller, which is related to the rotational phase of the driver roller (velocity fluctuation caused by the eccentricity of the driver roller), whereas the swelling wave-like fluctuation, which is depicted by the broken line, corresponds to the fluctuation Vh in the velocity of the conveyer belt, which is related to the nonuniformity in the thickness of the conveyer belt.

The color deviation caused by the fluctuation of the conveyer belt velocity related to the rotational phase of the driver roller 131 can be prevented by making the distance between the adjacent two photosensitive drums, for example, between the photosensitive drums 111 and 113, equal to the circumference of the driver roller 131. This solution can prevent the occurrence of the toner image difference among the plural sheets of transfer medium, but fails to prevent the occurrence of the color deviation on each sheet of recording medium. In other words, this solution fails to prevent the color deviation caused by the nonuniformity in the thickness of the conveyer belt.

The image forming apparatus described above comprised the transfer medium conveyer belt 126 which was disposed so that it came in contact with the plurality of image bearing members. This description of the image forming apparatus also applies to an image forming apparatus which comprises an intermediary transfer belt which is disposed so that it comes in contact with a plurality of image bearing members, and an image forming apparatus which comprises a photosensitive belt on which images are placed in layers by a plurality of image formation stations.

SUMMARY OF THE INVENTION

The primary object of the present invention is to provide an image forming apparatus which can prevent the color deviation which occurs when a color image is formed on a transfer medium in the form of a belt, or a piece of transfer medium become on a bearing means in the form of a belt.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 11 is a table which shows the amount of compensation to be made based on the data regarding the thickness of the belt.

DESCRIPTION OF THE PREFERRED EMBODIMENTS

Embodiment 1

Figure 1:
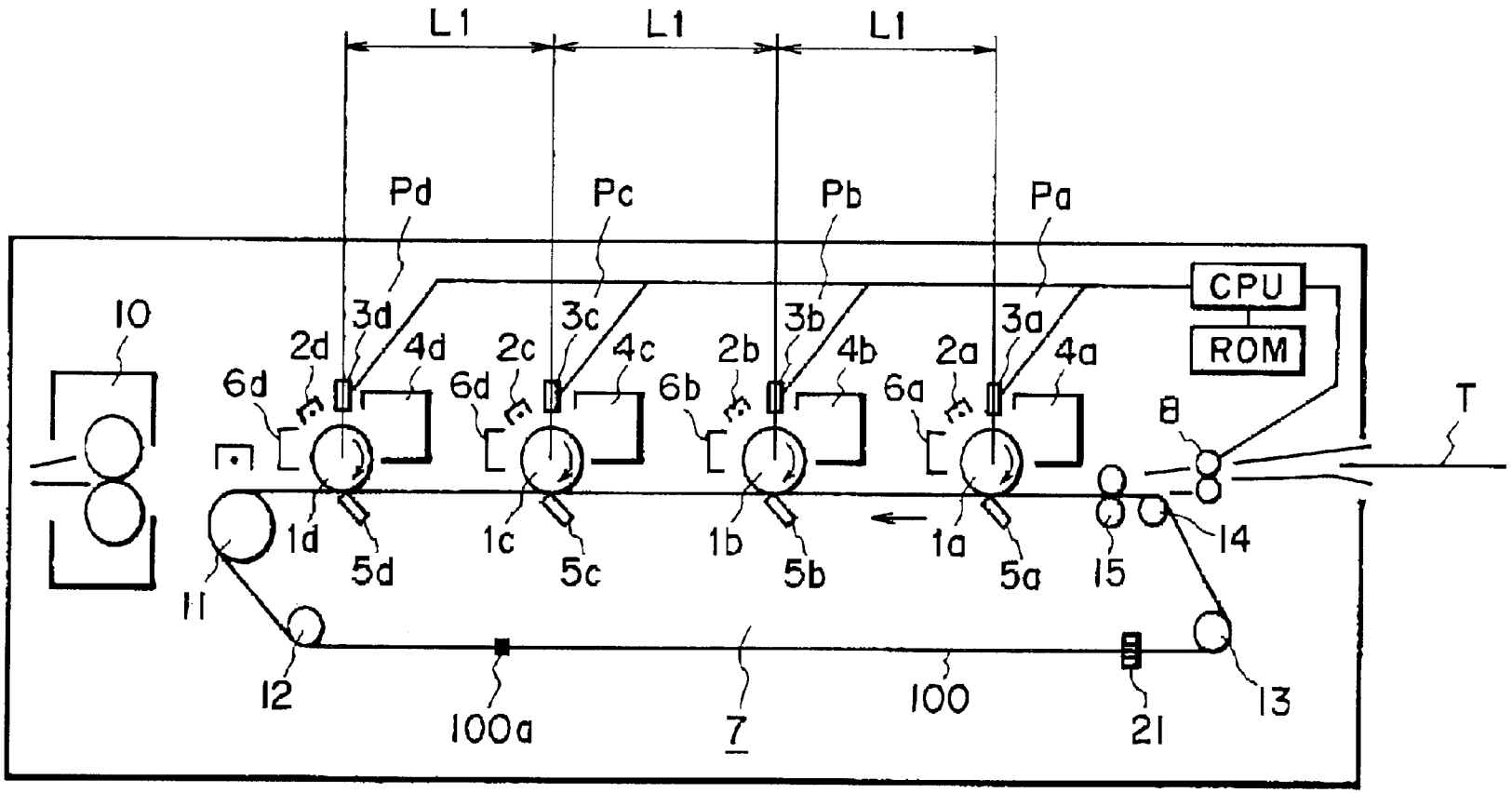
FIG. 1 is a vertical schematic sectional view of an image forming apparatus to which the present invention is applicable

Referring to FIG. 1, the electrophotographic color copying apparatus, as a color image forming apparatus, in this embodiment is provided with four image forming stations Pa, Pb, Pc and Pd, each of which comprises a rotational photosensitive drum 1*a* (1*b*, 1*c* or 1*d*) as an image bearing member dedicated to each image forming station. Each image forming station is also provided with a charging portion 2*a* (2*b*, 2*c* or 2*d*), an exposing portion (LED) 3*a* (3*b*, 3*c* or 3*d*), a developing portion 4*a* (4*b*, 4*c* or 4*d*), a transferring portion 5*a* (5*b*, 5*c* or 5*d*), and a cleaning portion 6*a* (6*b*, 6*c* or 6*d*), which are dedicated to each image forming station.

The image forming apparatus is also provided with a transferring means in the form of an endless belt, which extends below the plurality of photosensitive drums 1*a*–1*d* in a manner to horizontally penetrate the plurality of the image forming stations Pa–Pd. In other words, the image forming apparatus is provided with a belt type conveying apparatus 7 as a conveying means, and is structured so that a sheet of transfer medium T fed into the image forming apparatus by a registration roller disposed at one of the longitudinal ends of the belt of the conveying apparatus 7 is conveyed through the transferring portion 5*a* (5*b*, 5*c* and 5*d*) of each image forming station Pa (Pb, Pc and Pd).

In the case of an electrophotographic color image forming apparatus such as the one described above, a color image is formed in the following manner.

First, a latent image correspondent to the yellow color component in an original image is formed on the photosensitive drum 1*a* by a known electrophotographic means comprising the charging portion 2*a* and exposing portion 3*a* of the first image forming station Pa. Then, this latent image is developed into a visible image in the developing portion 3*a* with the use of developer which contains yellow toner. The visualized image, i.e., the yellow toner image, is transferred, in the transferring portion 5*a*, onto a piece of transfer medium T which has been delivered to the transferring portion 5*a* by the belt type conveying apparatus 7.

While the yellow toner image is transferred onto the transfer medium T, a latent image correspondent to the magenta color component in the original image is formed on the photosensitive drum 1*b* in the second image forming station Pb as in the case of the yellow toner image, and then, the latent image is developed into a magenta toner image with magenta toner in the developing portion 4*b*. Then, as the transfer medium T, on which the transfer of the yellow toner image has been completed in the first image forming station, is conveyed into the second image forming station, the magenta toner image is transferred onto the same transfer medium T, across the predetermined area.

Thereafter, the same image forming process as the one described above is carried out for the cyan and black color components of the original image to place four toner images of different color in layers on the transfer medium T. Then, the transfer medium T is conveyed to a fixing portion 10 disposed at the longitudinal end of the belt of the conveying apparatus 7, on the side opposite to the image forming stations. In the fixing station 10, the toner images on the transfer medium T are fixed to the transfer medium T. becoming a permanent full-color image on the transfer medium T.

After the completion of the transfer of the toner images from the photosensitive drums 1*a*–1*d*, the residual toner, that is. the toner remaining on the photosensitive drums 1*a*–1*d*, is removed by the cleaning means 6*a*–6*d*, to prepare the photosensitive drums 1*a*–1*d* for the following cycle of latent image formation.

At this time, referring to FIGS. 1 and 2, the belt type conveying apparatus 7 for conveying the transfer medium used in the aforementioned color image forming apparatus will be described further.

Figure 2:
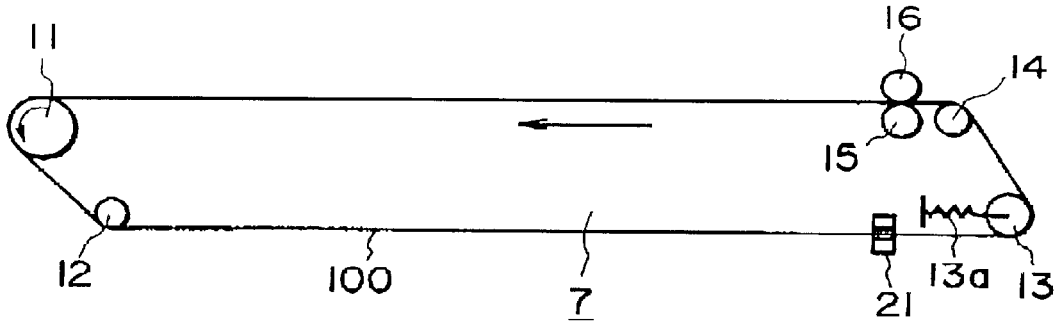
FIG. 2 is a vertical schematic sectional view of a conveying apparatus which comprises a belt

First, referring to FIG. 2, the conveyer belt 100, that is, the transfer belt, of the belt type conveying apparatus 7 is stretched around the driver roller 11, and the first, second, and third follower rollers 12, 13 and 14. As the driver roller 11 is rotated, the conveyer belt 100 runs in the direction indicated by an arrow mark in the drawing.

Among the first to third follower rollers 12–14, the first follower roller 12 is fixed, along with the driver roller 11, in the position relative to the belt type conveying apparatus 7.

The second follower roller 13 doubles as a tension roller, being assisted by an elastic member 13*a*, such as a spring, which provides the conveyer belt 100 with a predetermined amount of tension.

The third follower roller 14 is structured so that its axis can be moved within the plane parallel to the transfer medium bearing surface of the conveyer belt 100, to adjust it in terms of its parallelism relative to the driver roller 11. In other words, the third follower roller 14 functions as an alignment roller. The deviation of the conveyer belt 100 in the direction of the primary scanning can be controlled by adjusting the alignment of this third follower roller 14 relative to the driver roller 11, so that the conveyer belt 100 does not excessively deviate, that is, the conveyer belt 100 remains virtually centered.

Also referring to FIG. 2, the belt type conveying apparatus 7 in this embodiment comprises the fourth follower roller 15 disposed adjacent to the third follower roller 14, and a presser roller 16 paired with the fourth follower roller 15 to pinch the conveyer belt 100 between the rollers 15 and 16.

Figure 3:
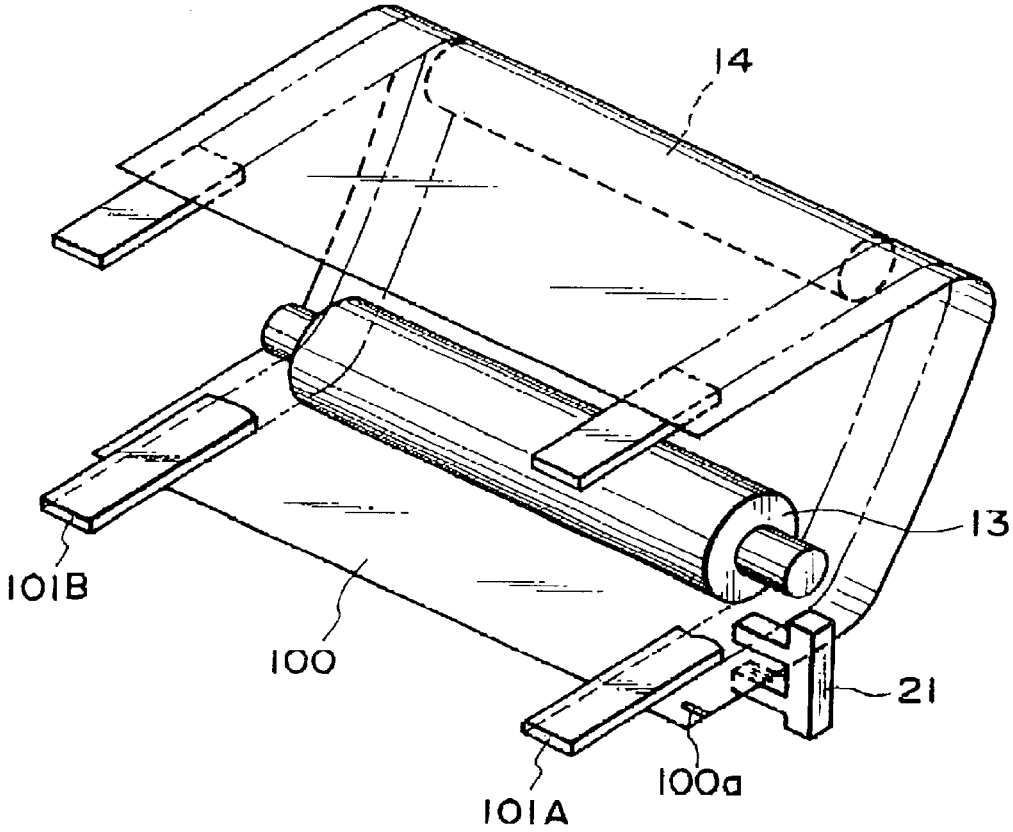
FIG. 3 is a schematic perspective view of one of the essential portions of the belt type conveying apparatus.

Next, referring to FIG. 3, the conveyer belt 100 is provided with guide ribs 101A and 101B, which are glued to the inward surface of the conveyer belt 100, outside the transfer range in terms of the direction perpendicular to the running direction of the belt, the guide ribs 101A being along one of the edges of the conveyer belt 100 and the guide ribs 101B being along the other. These guide ribs 101A and 101B work with the corresponding shoulder portions of the second follower roller 13, which doubles as the tension roller, to control the conveyer belt 100 so that it does not deviate or snake.

The conveyer belt 100 is also provided with a rectangular slit 100*a*, which is located at one of the edges of the conveyer belt 100. The belt type conveying apparatus 7 also comprises a photosensor 21, as a detecting means which is provided with a light emitter element and a light receptor element, and is positioned in a manner to straddle the edge portion of the conveyer belt 100, enabling the photosensor 21 to detect the slit 100*a*, so that the referential point of the conveyer belt 100 in terms of its circumferential direction can be recognized as the output signal of the photosensor 21 is detected.

Figure 4:
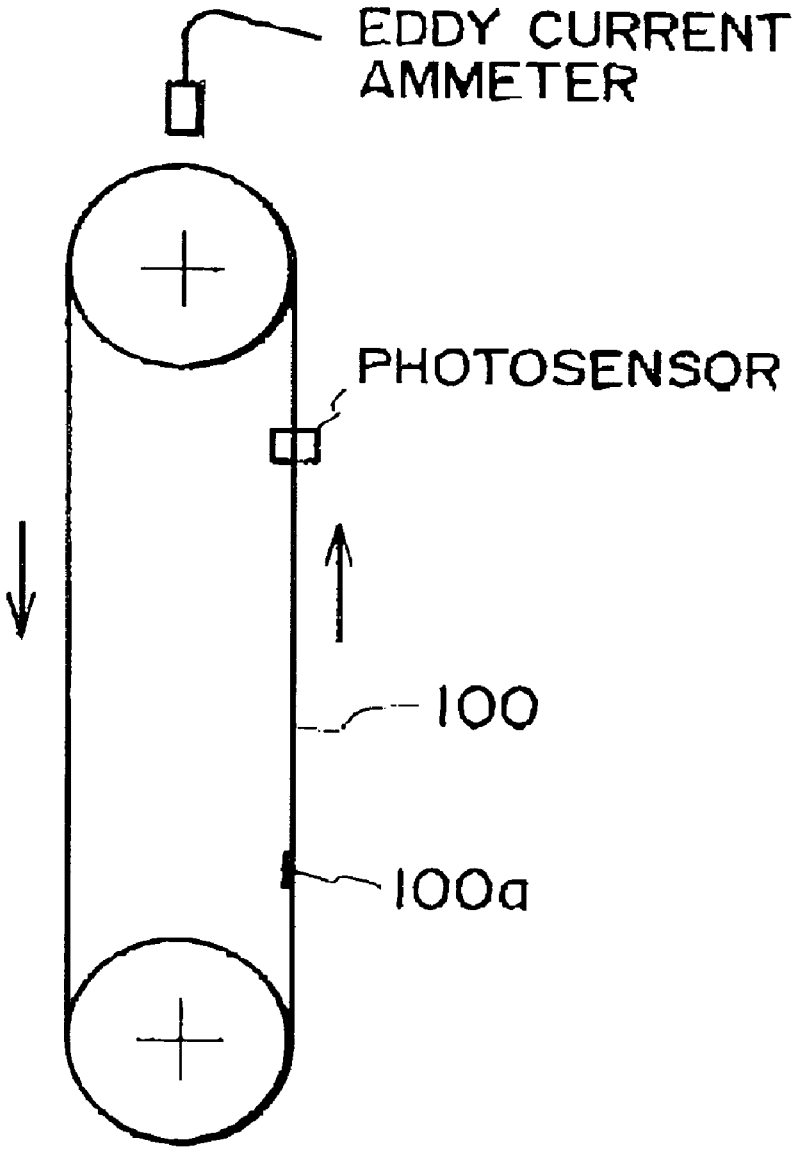
FIG. 4 is a schematic sectional drawing which depicts a system for obtaining the data regarding the thickness of the belt.

Next, referring to FIG. 4, one of the methods for measuring the variation in the thickness of the conveyer belt 100 in its circumferential direction will be described.

As depicted in the drawing, a conveyer belt to be measured is stretched around two electrically conductive roller (metallic roller), with the application of a tension of 40N Then, an eddy current flow meter is positioned a predetermined distance away from the outward surface of the conveyer belt, in the area (range) where the conveyer belt is in contact with one of the rollers. The data regarding the thickness of the conveyor belt are obtained by measuring the conveyer belt with the eddy current flow meter, at predetermined points in time set with reference to the referential time, that is, the time at which the aforementioned slit 100*a* passes the photosensor 21.

More specifically, the data reflecting the thickness of the conveyer belt, across the aforementioned portion in contact with one of the metallic rollers at any given point in time, are obtained by measuring the conveyer belt by the eddy current flow meter at any three points selected so that they align in the direction perpendicular to the running direction of the belt (preferably, three points on the front, middle, and rear sides, which are evenly distanced from each other). Obviously, these three points are selected to be within the region in which the belt is in contact with the driver roller.

The average value of the thus obtained belt thickness data is stored in a predetermined storing apparatus. The above process is consecutively and discretely carried out for each of the predetermined sequential measurement points on the conveyer belt until the average values of the thickness data for all the measurement points are stored in the aforementioned storing apparatus.

The data stored in this storing apparatus are printed on a label which will be described later. However, the aforementioned process of storing the data into the storing apparatus may be omitted In this case, the average values of the data from the give three points are to be sequentially printed on a label as they are obtained.

In order to correlate the data regarding the belt thickness to the specific points of the belt, the belt thickness is measured with reference to the slit 100*a*. However, this referencing of the measurement points to the position of the slit 100*a* is not mandatory. In other words, the data regarding the belt thickness may be obtained with reference to a point other than the position of the slit 100*a*. for example, any point on the belt, of which positional relationship to the slit 100*a* is specified.

The description will be made as to the structures using the present invention.

The conveyer belt 100 is formed through a centrifugal molding, for example. According to this embodiment, the thickness of the belt 100 is measured over the entire circumference in the circumferential direction after the conveyer belt 100 is formed, so that thickness distribution (thickness profile) in the circumferential direction is determined. The slit 100*a* functions as a reference point of the circumference of the conveyer belt (home position) so that thickness of the conveyer belt is a function of a circumferential position relative to the home position.

Figure 5:
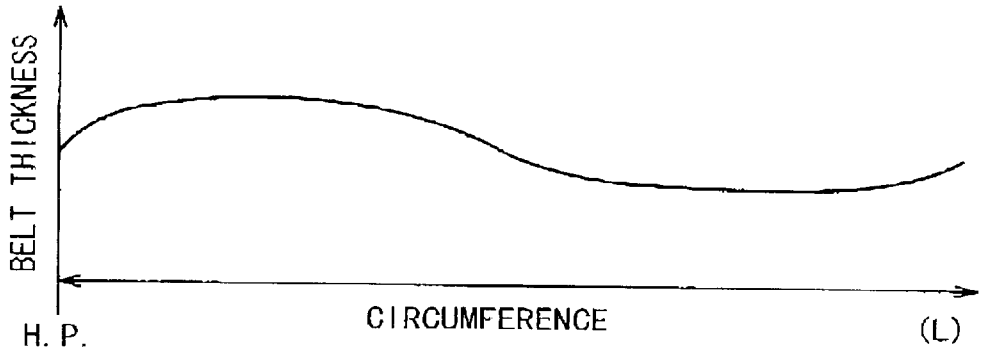
FIG. 5 is a graph which shows the positional difference in the thickness of the belt.

The thickness of the conveyer belt 100 is substantially constant in the widthwise direction of the conveyer belt (the direction perpendicular to the moving direction of the belt), and therefore, it will suffice if the thickness is measured at one of the front side, the central position and the rear side in the widthwise direction in FIG. 1, although it may be measured at positions different in the widthwise direction. A number of conveyer belts 100 are manufactured in one manufacturing step, and it is empirically known that conveyor belts simultaneously manufactured have substantially the same thickness profiles in the circumferential direction. Therefore, the thickness profile in the circumferential direction of one conveyer belt can apply to the other belts simultaneously manufactured. For all of the belts, the home positions described in the foregoing is provided at the same phase positions in the same thickness profiles. FIG. 5 shows a typical profile in the circumferential direction.

Figure 6:
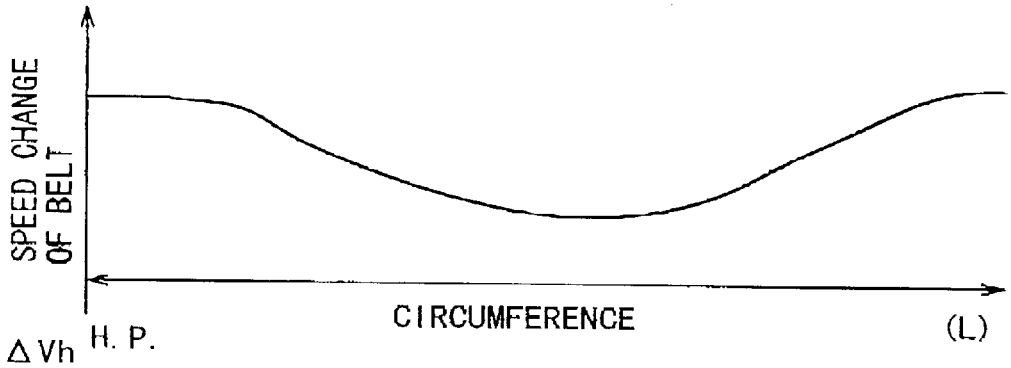
FIG. 6 is a graph which shows the function in the velocity of the belt.

During the image forming operation, the home position of the conveyer belt 100 rotated by the driving roller 11 is detected, by which the position of the conveyer belt can be known. Therefore, the variation $\delta V_h$ in the speed V attributable to the variation in the thickness of the conveyer belt 100. the thickness profile of which has been determined and is known, can be determined by calculation. The amount of deviation of the transfer position in the moving direction of the conveyer belt due to the speed variation of the conveyer belt can be calculated for each color toner image to be transferred from the photosensitive drum 1*a*–1*d* onto the transfer material, by which the amount of the deviation of the transfer position can be predicted. FIG. 6 shows a speed variation $\delta V_h$ distribution (profile) attributable to the variation in the thickness of the conveyer belt.

According to this embodiment of the present invention, a correction is made to change the timing of start of image exposure in the scanning operation in the sub-scan direction of the exposure of the photosensitive drum with which the deviation in the transfer position occurs. By the correction. the color toner images are overlaid without positional deviation on the transfer material so that resultant color image is substantially free from color misregistration. The misregistration if any is not a problem from the practical standpoint. In any event, the positional deviation between or among the transfer stations can be controlled or corrected.

Figure 7:
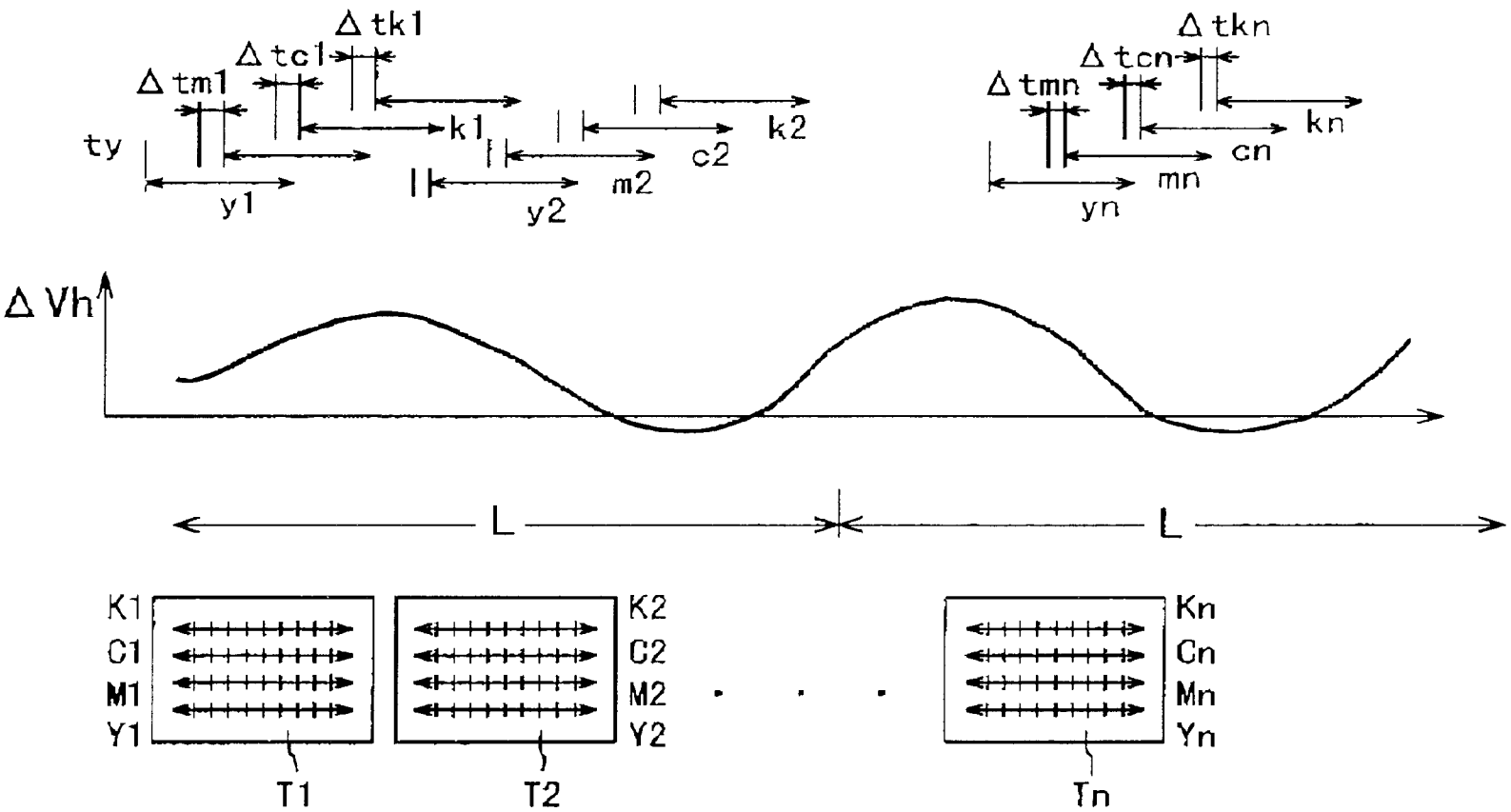
FIG. 7 is a schematic drawing which shows the results of the compensatory control, in the first embodiment, executed to prevent the occurrence of color deviation.

FIG. 7 schematically shows a relationship of the positional deviation when the color misregistration correction is carried out according to this embodiment.

In FIG. 7, the abscissa of the graph represents time t, and the ordinate represents the speed variation $\delta V_h$ attributable to the thickness variation of the conveyer belt. Lower-case letter tyl at the upper part of the graph indicates the time of the exposure start for the photosensitive drum 1*a* in the sub-scan direction for the yellow image in the image formation for the first transfer material, and δtm1, δtc1 and δ6tk1 indicate the advanced or delayed length of times from the theoretical timing for the exposure start in the siib-scan direction for the magenta, cyan and black images on a photosensitive drums 1*b*, 1*c* and 1*d*, namely, they indicate the amounts of correction of the exposure start timing. The same occurs to the characters with suffix 2.

For example, as to the first transfer material in FIG. 7, the positional deviation in the feeding direction of the conveyer belt is predicted for the magenta, cyan and black images. In order to align the leading edges of the images for the magenta, cyan and black images, the timings of the exposure start in the sub-scan direction is advanced in accordance with the positional deviations by δt (δtm1, δtc1 and δtk1).

As described in the foregoing, the positional deviation of the transfer of the toner image onto the prediction due to the speed variation of the conveyer belt 100 is predicted, and if the prediction indicates the occurrence of the deviation, the timing of the start of the exposure of the photosensitive drum is advanced or delayed by the amount δt of the predicted positional deviation for the scanning in the sub-scan direction, corresponding to the toner image for which the deviation is predicted. By doing so, the respective color toner images can be transferred onto the transferer material without positional deviation of the leading edges. as indicated by cross-lines Y1–K1 of the first transfer material, for example, T1 in FIG. 7.

According to this embodiment, the leading edges of the toner images to be overlaid on the transfer material can be aligned, so that color misregistration can be avoided.

The control of the timing of the exposure start of each of the photosensitive drum is based on the sheet feeding timing of the transfer material by the pair of the registration programs controlled by CPU and on the prediction of the position of the transfer material carried on the belt.

Embodiment 2

As for an image which involves the positional deviation (color misregistration) of image chancellor due to the variation in the speed resulting from the non-uniformity in the thickness of the conveyer belt 100, the image may be contracted or elongated as a whole in the feeding direction of the conveyer belt to such an extent that positional deviation due to the contraction or elongated is not negligible. That is, if the speed of the conveyer belt is higher at the transfer position, the image is elongated, and on the contrary, if the speed is lower, the image is contracted. In any case, the positional deviation occurs in the moving direction of the conveyer belt as a whole of the image.

Figure 8:
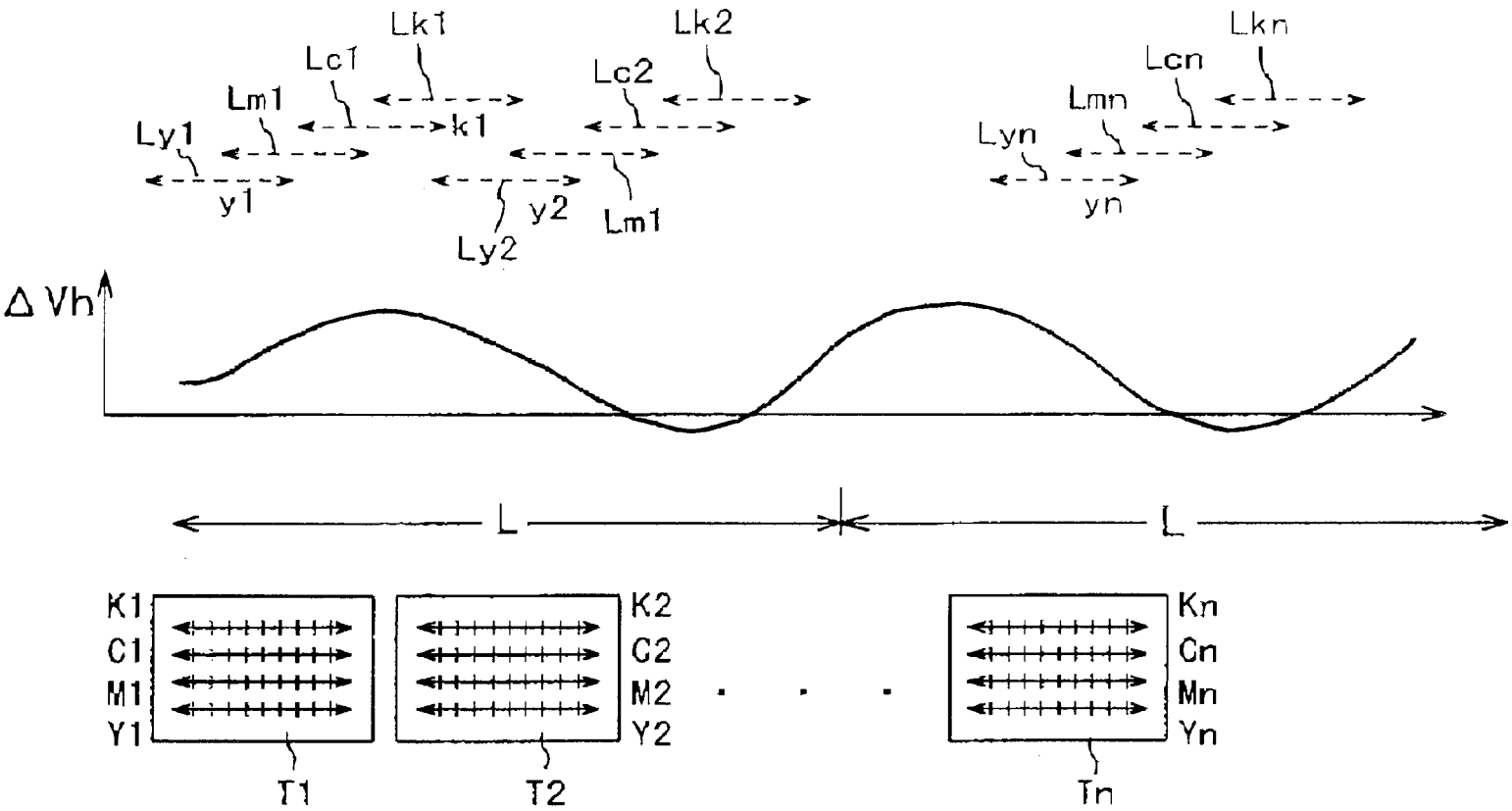
FIG. 8 is a schematic drawing which shows the results of the compensatory control, in the second embodiment, executed to prevent the occurrence of color deviation.

The exposure time Ly1–Lk1 shown in FIG. 8 is determined so as to eliminate the positional deviation as a whole of the image by correcting on the basis of the prediction of the positional deviation as a whole of the image. More particularly, if the positional deviation is the deviation of the image as a whole due to elongation of the image, the scanning in the sub-scan direction is effected with reduced exposure time period, and in the deviation is the positional deviation due to the contraction all the image, the entire exposure period of time is elongated.

As described in the foregoing, the positional deviation of the transfer of the toner image onto the transfer material due to the variation in the speed of the conveyer belt 100 is predicted, and if the prediction indicates that positional deviation actually occurs at the transfer position, the correction is made to elongate or contract the exposure period of time in accordance with the amount of deviation of entirety of the image for the scan in the sub-scan direction of the exposure of the photosensitive drum corresponding to the toner image with which the deviation is predicted. For example, as shown in FIG. 8, the toner image can be transferred onto the first transfer material T1 such that lengths of the images are substantially the same and constant, as indicated by cross-lines Y1–K1.

According to this embodiment, the lengths of the toner images of the different colors to be overlaid can be made the same, so that color misregistration can be suppressed.

The control of the exposure period of time of each of the photosensitive drums is based on the information of the sheet feeding timing of the transfer material by the pair of the registration rollers controlled by CPU and is based on the prediction of the position of the transfer material carried on the belt.

Embodiment 3

According to this embodiment, the leaning edges of the toner images of different colors to be transferred onto the transfer material, and in addition, the lengths of the toner images are made the same.

Figure 9:
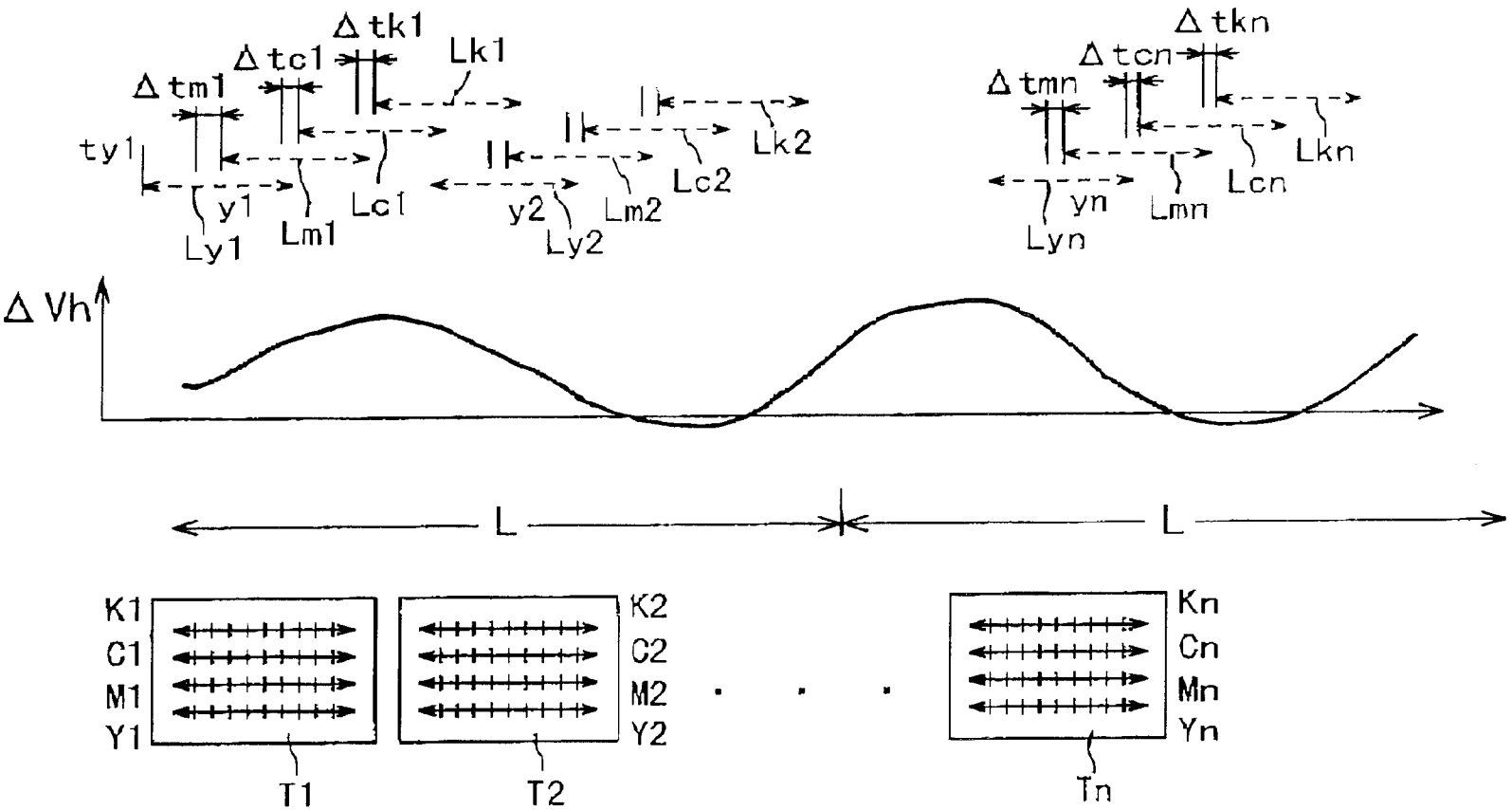
FIG. 9 is a schematic drawing which shows the results of the compensatory control, in the third embodiment, executed to prevent the occurrence of color deviation.

For example, as to the first transfer material in FIG. 9, the positional deviation in the feeding direction of the conveyer belt is predicted for the magenta, cyan and black images. In order to align the leading edges of the images for the magenta, cyan and black images. The timings of the exposure start in the sub-scan direction is advanced in accordance with the positional deviations by δt (δtm1, δtc1 and δtk1).

As described in the foregoing, the positional deviation of the transfer of the toner image onto the prediction due to the speed variation of the conveyer belt 100 is predicted, and if the prediction indicates the occurrence of the deviation, the timing of the start of the exposure of the photosensitive drum is advanced or delayed by the amount δt of the predicted positional deviation for the scanning in the sub-scan direction, corresponding to the toner image for which the deviation is predicted. By doing so, the respective color toner images can be transferred onto the transferer material without positional deviation of the leading edges, as indicated by cross-lines Y1–K1 of the first transfer material T1 in FIG. 9.

Double head broken lines Ly1–Lk1 at an upper part of the graph of FIG. 9 indicate exposure time for the respective colors, provided by subtracting the amount of correction δt for the exposure start time from the exposure time. For the yellow image, however, δt=0, and therefore, Ly1=y1. Furthermore, according to this embodiment, the positional deviation of the entire image is predicted and corrected, by the exposure is carried out with the exposure time provided by adding the correction amount δt for the exposure start time to the exposure time Ly1–Lk1, for each color. More particularly, if the positional deviation of the entirety of the image is caused by elongation of the image, the exposure scanning of the photosensitive drum in the sub-scan direction is carried out with the entire exposure time contracted, and if the positional deviation thereof is caused by the contraction of the image, the exposure scanning is carried out with the entire exposure time elongated.

As described in the foregoing, the positional deviation of the transfer of the toner image onto the transfer material due to the variation in the speed of the conveyer belt 100 is predicted, and if the prediction indicates that positional deviation actually occurs at the transfer position, the correction is made to elongate or contract the exposure period of time in accordance with the amount of deviation of entirety of the image for the scan in the sub-scan direction of the exposure of the photosensitive drum corresponding to the toner image with which the deviation is predicted. For example. as shown in FIG. 9, the toner image can be transferred onto the first transfer material T1 such that lengths of the images are substantially the same and constant, as indicated by cross-lines Y1–K1.

Thus, according to this embodiment. The four color toner images can be transferred onto the transfer material substantially with the leading ends and trailing ends aligned respectively so that color misregistration can be effectively avoided.

Embodiment 4

In the Embodiments 1–3, the color misregistration is corrected using data of thickness non-uniformity of the conveyer belt along the entire circumference of the conveyer belt 100 (profile). It is cumbersome and time consuming to carry out the correction calculation for the entire profile, and the amount of the calculation is very large with the result of expensive control device.

In view of this, according to this embodiment, the entire circumference of the belt is divided into N sections, and the thickness in each section is represented by an average, so that N representative thicknesses are used as the thickness profile, by which the calculation and therefore the control are simplified.

For example, the entire circumference of the belt is equally divided into 8 sections and the thickness profile is determined by the 8 thickness data.

Figure 10:
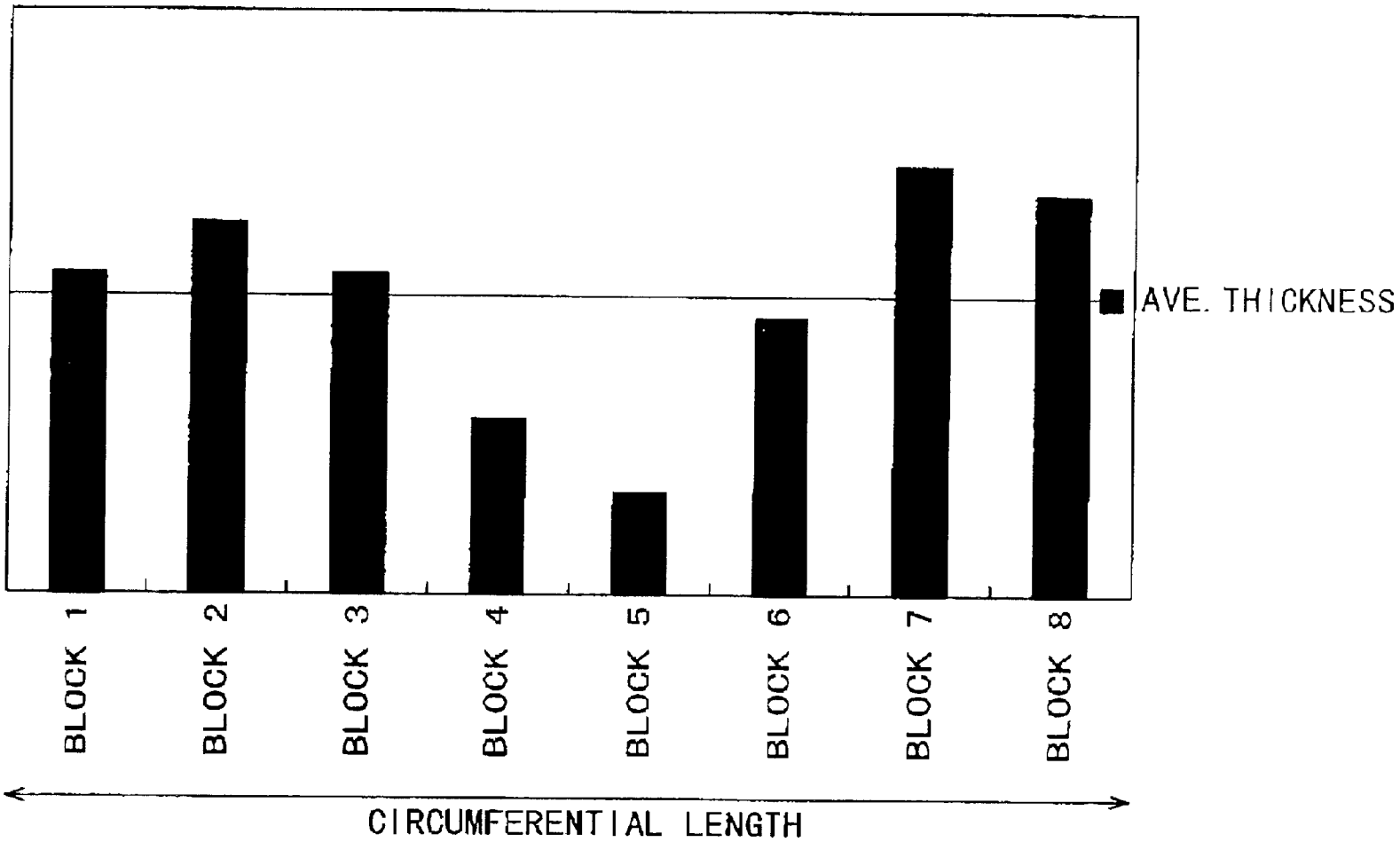
FIG. 10 is a graph which shows the positional difference in the thickness of the belt among a predetermined number of sections into which the belt was divided.

In each of the sections provided by the division, one datum which is the average thickness is used for determining the profile, so that profile for the entire circumference of the belt is determined by 8 data of thickness, as shown in FIG. 10 The correction in which the interval of time of the exposure operation (interval of the start timing of the exposure operation of the photosensitive drum) is increased or decreased corresponding to the value representing the speed variation resulting from the thickness profile of the entire circumference of the conveyer belt, is carried out N times in the entire circumference, so that exposures are carried out at stepwise time intervals.

By doing so, the images can be transferred onto the transfer material attracted and carried on the conveyer belt without significant influence of the speed variation of the belt resulting from the thickness distribution.

That is, the speed variation and the resultant positional deviation in the moving distance between the image bearing members for the image formation on a single transfer material, is predicted, and the positional deviation due to the speed variation of the conveyer belt is represented by non-continuous values, so as to minimize the positional error. In addition, the relative positional relation between or among the transfer material can be made constant Referring to FIG. 11, more detailed description will be made.

Thus, the amount of the positional deviation of transfer resulting from the speed variation Vh attributable to the non-uniform thickness of the conveyer belt is predicted on the basis of non-continuous data provided for 8 sections into which the entire circumference of the belt is equally divided, and the exposure time is corrected in the following manner, by which the images can be aligned on the transfer material.

First, the amount of each of the transfer positional deviations Yx1–Yx8, Mx1–Mx8, Cx1–Cx8 and Kx1–Kx8 due to the speed variation Vh is predicted by calculation for the corresponding section on the basis of the data H1–H8 of the thickness thickness of the conveyer belt;.

The correction amounts Me1–Me8, Ce1–Ce8 and Ke1–Ke8 for imparting corrections to the design exposure positions in the sub-scan direction of the image bearing member, relative to a reference image bearing member (Y in FIG. 11), are determined.

Based on the exposure start time in the sub-scan direction for the reference image bearing member (Y in FIG. 11), the exposure start times in the sub-scan direction for the other image bearing members are advanced or delayed with respect to the design or original set times by Mt1–Ht8, Ct1–Ct8 and Kt1–Kt8, respectively, so that leading edges of the toner images of the different colors can be aligned with each other on the transfer material T1.

The relative position of each of the sections relative to the home position (slit 100*a*) on the conveyer belt, can be determined if the positional relation between each of the sections and the home position is determined. Therefore, it is possible which section is going to be placed to the exposure device can be predicted beforehand on the basis of the timing at which the home position is at the sensor.

In this embodiment, similarly to the foregoing embodiments, the lengths of the image (electrostatic latent image), measured in the sub-scan direction (perpendicular to the peripheral movement of the photosensitive drum, of the image formed on the photosensitive drum, may be controlled using the 8 data of non-uniformity of the thickness, For example, the color misregistration can be suppressed by controlling the time period of the exposure of each of the photosensitive drums (for example, the time period from the exposure start time (first line) for formation of an image to the end time of the end of the exposure (final line)).

The thickness data may be prepared beforehand for each conveyer belt then, before the image forming apparatus is shipped or after the replacement of the conveyer belt. The data may be inputted to ROM (storing means) by a separate inputting means, for example, a liquid crystal display portion on the top of the apparatus. Then, during the image forming operation, the correction can be imparted always to the exposure means by the CPU (control means).

In this embodiment, 8 data are used for the thickness of the belt to effect the color misregistration correction control, but the number is not limited to 8. It is preferable to effect the color misregistration correction control using at least two thickness data, and the number of data can be determined properly by one skilled in the art.

Embodiment 5

This embodiment is different from the foregoing embodiment in that position of the transfer material attracted and carried on the conveyer belt is fixed. Therefore, the data capacity required for the ROM can be further reduced, so that load of the CPU can be reduced.

Figure 12:
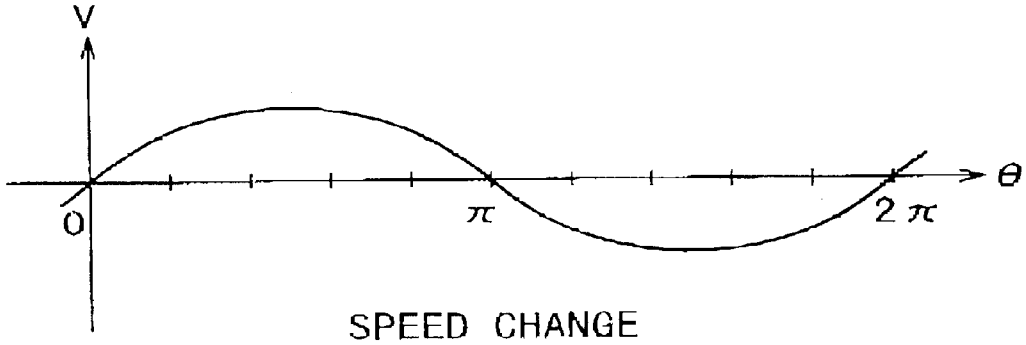
FIG. 12(*a*), is a graph which shows the fluctuation in the belt velocity, and FIG. 12(*b*), is a graph which shows the positional deviation of the belt in terms of the circumferential direction.
Figure 12:
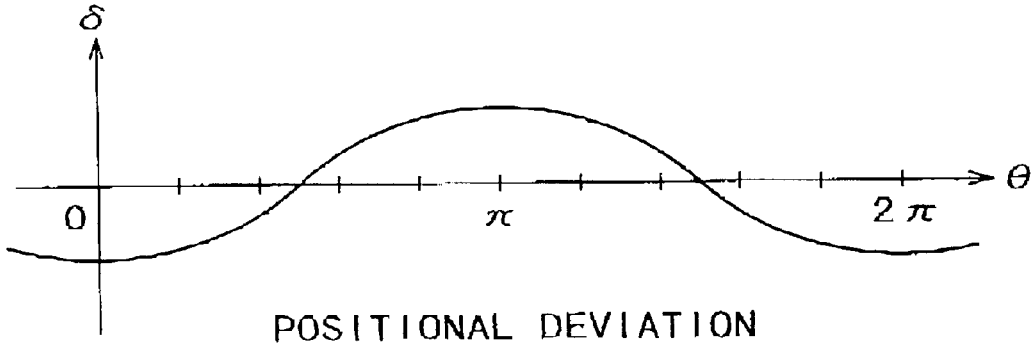

FIG. 12 is a graph showing the change of the feeding speed when the conveyer belt 100 rotates through one full turn. The abscissa represents an angle θ, and 2πradian corresponds to one full turn of the conveyer belt 100, therefore, the angle θ indicates a circumferential position. The point of origin in the abscissa θ is determined at any position using the output signal of the photo-sensor 21 on the basis of the position of the slit 100*a*. The ordinate represents the speed v in transfer sheet feeding plane of the conveyer belt 100.

FIG. 12 shows a simple model in which the feeding speed v (θ) changes in the form of a sine curve in one period of the conveyer belt 100 rotation. That is, the feeding speed v (θ) is a function of θ and is expressed as follows:

$$V(\theta)=A\ \mathrm{sing}\theta \text{ (A is constant).}$$

This is the amount of deviation from (larger than or smaller than) the average speed V in the one period.

The conveyer belt 100 may involve the difference (non-uniformity) in the thickness along the circumference due to the manufacturing method (centrifugal molding). When the portion having a thickness larger than the average thickness is contacted to the driving roller 11, the feeding speed v (θ) is larger than the average speed corresponding to the difference of the length of arm of the rotation (pitch circle) This is shown above the average speed V.

On the contrary, when the portion of conveyer belt 100 having a thickness smaller than the average thickness is contacted to the driving roller 11, the feeding speed v (θ) corresponding to the difference of the length of arm or the rotation (pitch circle). This is shown below the average speed V.

For the determination of the profile of the feeding speed v (θ) due to the distribution of the thickness of the belt shown in FIG. 12,(*a*), it is preferably determined by actual measurement for each of the conveyer belt 100. Or, if the non-uniformity of the thickness due to the manufacturing of the conveyer belt 100 is constant, the profile can be determined without actually measuring the feeding speed.

FIG. 12,(*b*) is a graph showing a change in the positional deviation from the ideal condition under which the feeding speed v (θ) at each point on the conveyer belt 100 is constant, during one full rotation of the conveyer belt 100. The abscissa represents θ, and 2πradian means one full turn of the conveyer belt 100, similarly to the graph of the feeding speed v (θ) in FIG. 12,(*a*).

The ordinate represents a positional deviation δ (θ) in the feeding direction. The position changing (displacement) is an integration of the speed, and therefore, $$\delta(\theta)=v(\theta)d\theta=-B\cos\theta \text{ (B is constant).}$$

The position is before or after the ideal position by this amount. The positive area in the ordinate means that point on the conveyer belt is advanced beyond the ideal position, and the negative area means that it is delayed beyond the ideal position.

Figure 13:
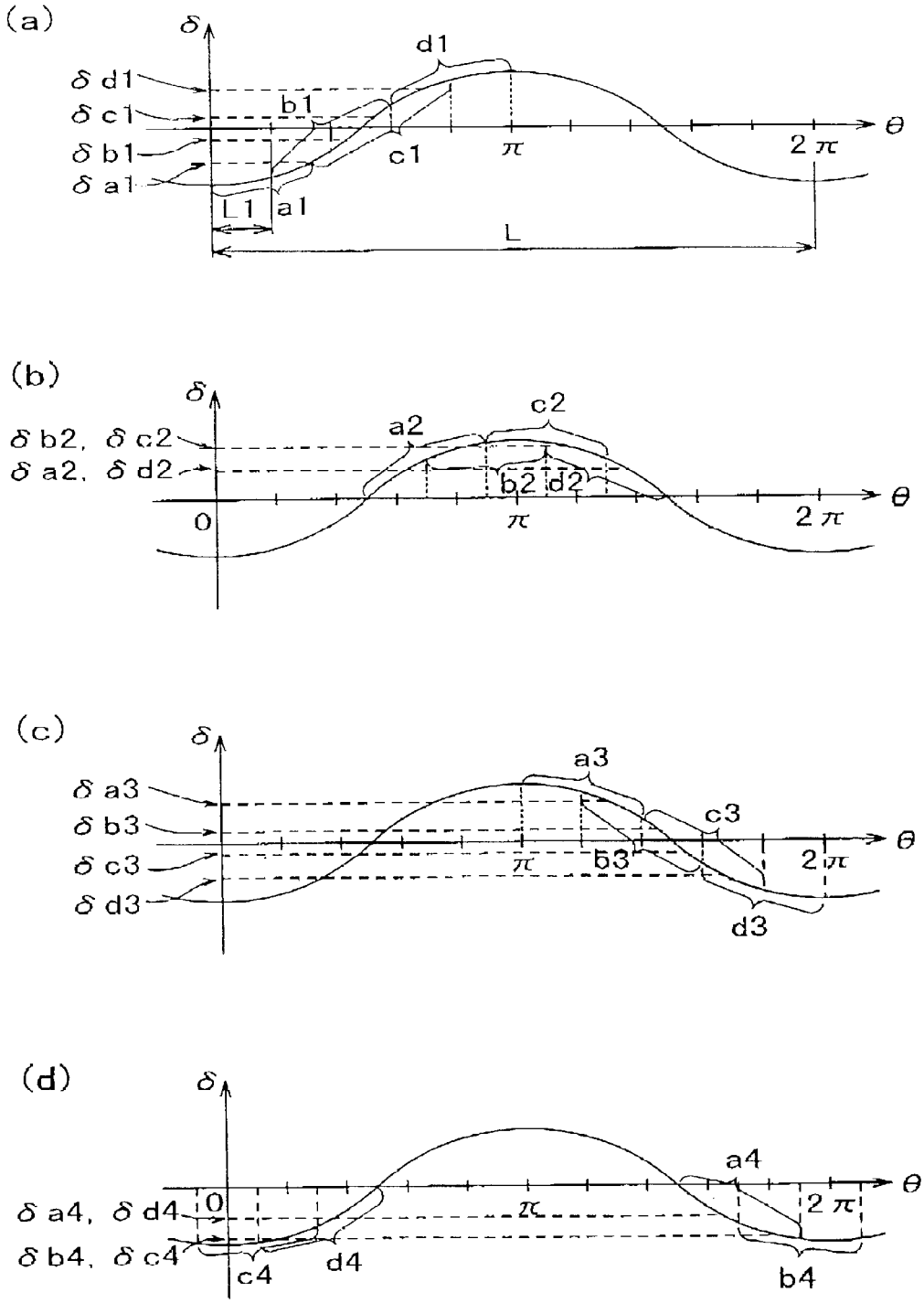
FIG. 13 is a graph which shows the positional deviation of the belt in terms of the circumferential direction.

FIGS. 13(*a*)–13(*d*) shows a positional deviation δ (θ) when each transfer sheet passes through the image formation stations Pa Pb, Pc, Pd in a continuous image formation mode in which the copies are produced continuously on transfer materials (transfer sheet s) of a predetermined size.

In this embodiment, the length of circumference of the conveyer belt 100 is L, and the feeding distance by one full rotation of the driving roller 11 is L1, and L=10×L1, that is, by 10 rotation of the driving roller 11, the conveyer belt 100 rotates one full turn.

The distance between the adjacent ones of the image formation stations is L1.

The transfer sheet of the predetermined size in this embodiment has a dimension 2L1 in the moving direction of the conveyer belt.

When the continuous copy operation is effected on the transfer sheets of the predetermined size, the transfer sheet is attracted on the conveyer belt 100 at the pitch of 2. 5L1. Thus, the transfer sheets are attracted for each time at predetermined four positions on the conveyer belt 100 with respect to the slit 100*a*.

FIG, 13(*a*) shows the positional deviations δ, when the first, fifth, ninth, 13th, . . . sheets passes through the image formation stations Pa, Pb, Pc and Pd in the continuous mode copying operation. The positional deviation when the image is transferred onto the transfer sheet in the image formation station Pa is within the range as indicated by a1, and the average positional deviation is δ a1 in this case. When the image is transferred onto the transfer sheet in the image formation station Pb, the positional deviation δ is in the range b1 which is deviated in the phase from the range a1, and the average positional deviation is δ b1 in this case.

Similarly, in the image formation station Pc, the range is c1, and the average positional deviation is δ c1. In the image formation station Pd, the range is d1, and the average positional deviation is δ d1.

FIG. 13(*b*) shows the positional deviations δ, when the seconds sixth, tenth, 14th, . . . sheets passes through the image formation stations Pa, Pb, PC and Pd in the continuous mode copying operation.

As described in the foregoing, the transfer sheets are sequentially attracted on the conveyer belt 100 at the pitches of 2. 5L1. In the similar manner, b2, δ b2, c2 δ c2, d2 and δ d2 are determined FIG. 13(*c*) shows the positional deviations δ, when the third, seventh, eleventh, 15th, . . . sheets passes through the image formation stations Pa, Pb, Pc and Pd in the continuous mode copying operation; and FIG. 13(*d*) shows the positional deviations δ, when the fourth, eighth, 12th, 16th, . . . sheets passes through the image formation stations Pa, Pb, Pc and Pd in the continuous mode copying operation. The reference characters of the range of the positional deviation during the feeding and the average positional deviation are similar to the foregoing example, and the description thereof is emitted for simplicity.

The major points of this embodiment will be described.

Referring to FIG, 13(*a*), for example, the image writing timing at each of the image formation stations Pa, Pb, Pc and Pd is adjusted for the first, fifth, ninth and 13th transfer sheets so as to minimize the image deviation (color misregistration) attributable to the variation in the feeding speed. Here, the values obtained by dividing the above-described average deviations δ a1, δ b1, δ c1 and δ d1, respectively, by the average speed V of the conveyer belt 100 are the adjustment values for the writing timings in the image formation stations. The adjustment values ta1 tb1, tc1, td1 are stored in memory (storing means) in the main assembly of the apparatus beforehand.

The adjustment values ta1 and tb1 are negative, which means that image is formed with delay by a predetermining time with respect to the ideal timing, and the adjustment values tc1 and td1 are positive which means that image formation is advanced from the ideal timing by a predetermined time As described in the foregoing referring to FIGS. 13(*b*), (*c*) and (*d*), the similar adjustment is effected for the other transfer sheets attracted and carried on the predetermined positions of the conveyer belt 100. In this case, the adjustment values ta1–td1 ta2–td2, ta3–td3 and ta4–ta4 are to be stored in the memory (ROM) of the main assembly of the apparatus, and the number of the values is 16.

As described in the foregoing, according to the embodiment, there is provided an image forming apparatus provided with a transfer material conveying belt contactable to a plurality of image bearing members, the image writing start timings of the exposure devices 3*a*–3*d* in the image formation stations corresponding to the profile of the thickness non-uniformity in the circumferential direction of the transfer material conveying belt determined beforehand, that is, corresponding to the thickness information of the belt stored in the ROM, by means of the CPU (control means). Therefore, the color misregistration or unevenness or non-uniformity of the color resulting from the non-uniformity of the thickness in the circumferential direction of the transfer conveyer belt can be minimized.

In this embodiment, similarly to the foregoing embodiments. The exposure time period (t length of the image in the sub-scan direction) of each of the photosensitive drum may be controlled by which the color misregistration can be suppressed. In this embodiment, when the image formation is carried out on transfer materials having a predetermined size, the transfer materials are supported at four positions on the belt, but the number is not limited to four. The number of the positions at which the transfer materials are carried may be controlled by CPU in accordance with the size of the transfer material by changing the intervals between the adjacent transfer materials. By doing so, when the images are continuously formed on the transfer materials, the circumferential length of the belt can be efficiently utilized to improve the throughput of image formation.

Embodiment 6

Figure 14:
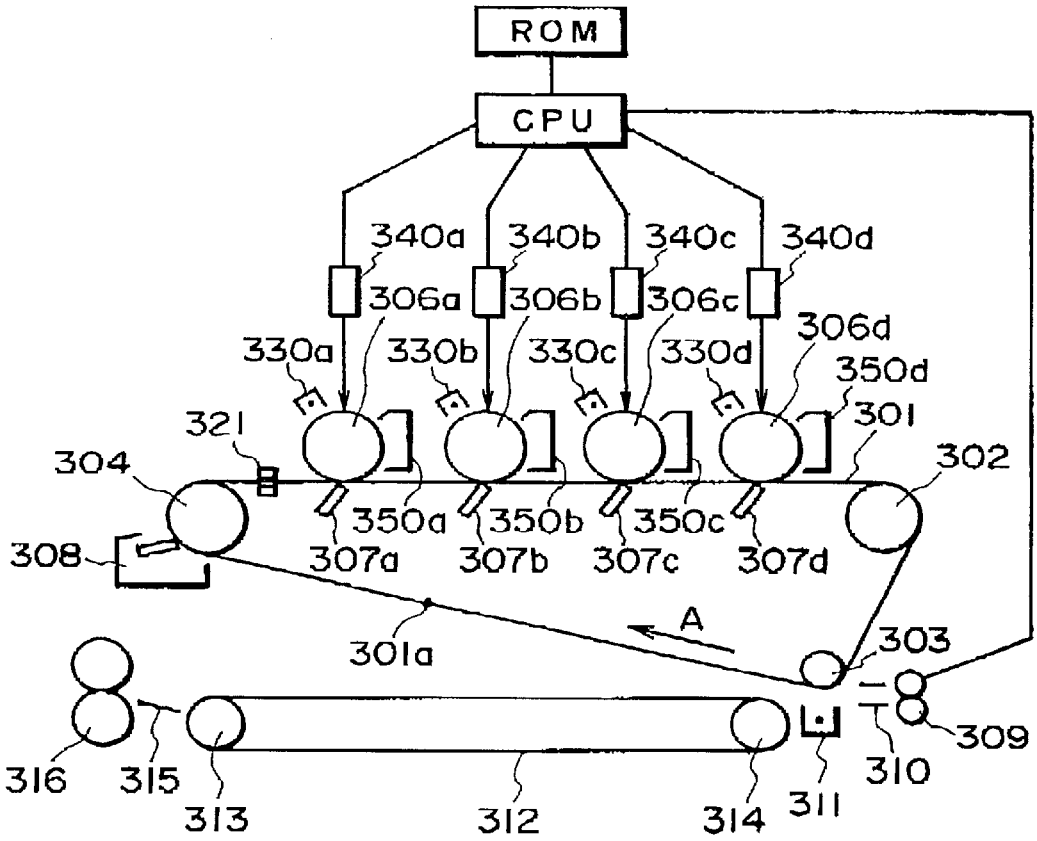
FIG. 14 is a schematic sectional view of the image forming apparatus in the sixth embodiment of the present invention.

Referring to FIG. 14, the description will be made as to Embodiment 6.

In this embodiment, the intermediary transfer belt 301 corresponds to the transfer material conveying belt 100 shown in Embodiments 1–5

In FIG. 14, the intermediary transfer belt 301 is stretched around the driving roller 302, and follower rollers 303 and 304, and travels in the direction indicated by an arrow A. Above the horizontal portion of the intermediary transfer belt 301, four photosensitive drums 306*a*, 306*b*, 306*c* and 306*d* are juxtaposed at regular intervals, and correspondingly, there are provided transferring electrodes 307*a*, 307*b*, 307*c* and 307*d* with the intermediary transfer belt 301 therebetween, contacting to the intermediary transfer belt 301. Around each of the photosensitive drums 306*a*–306*d*, primary chargers 330*a*–330*d*, exposure devices 340*a*–340*d* and developing devices 350*a*–350*d* are disposed similarly to the embodiment of FIG. 1.

The photo-sensor 321 provided between the follower roller 304 and the photosensitive drum 306*a* corresponds to the photo-sensor 21 shown in FIG. 1, and by detecting the slit 301*a* formed in the intermediary transfer belt 301 detects a reference position of the intermediary transfer belt 301 in the circumferential direction is detected.

The intermediary transfer belt 301 is moved in the direction A by the driving roller 302, during which the color toner images formed on the photosensitive drums 306*a*–306*d* are sequentially transferred onto the surface of the intermediary transfer belt 301 in a superimposed manner.

Adjacent the follower roller 303, there is provided a pair of registration rollers 309, so that transfer sheet fed out of the sheet feeding cassette (unshown) is fed at a predetermined speed to the transfer point formed by the follower roller 303 and the transfer corotron 311 at a timed relation through between the guiding plates 310.

The toner images having been transferred and superposed onto the intermediary transfer belt 301 are transferred onto the transfer sheet all together at the transfer point. The transfer sheet is fed by a transfer sheet conveyer belt 312 stretched around the driving roller 313 and the follower roller 314 and is guided by the guide 315 to the pair of fixing rollers 316. The toner images of the different colors on the transfer sheet are fixing into a full-color image by heat and pressure provided by the pair of the fixing rollers 316.

After the transfer operation, the intermediary transfer belt 301 is cleaned by a cleaner 308 disposed adjacent the follower roller 304 so that untransferred toner is scraped off the transfer belt 301 to be prepared for the next image transfer operation. In this embodiment, the description as to the speed profile relating to the thickness non-uniformity of the intermediary transfer belt 301, the adjustment values for the exposure start timing and the exposure time period. The fundamental concept is the same as with Embodiments 1–5, that is, the color misregistration and the color unevenness attributable to the travelling speed variation resulting from the non-uniformity of the thickness of the intermediary transfer belt 301, are minimized.

In this embodiment, in response to the detection signal provided by the passing of the slit 301*a* formed in the intermediary transfer belt, the feeding timing of the transfer material to the 2 next transfer portion and the positions and the interval of the images on the intermediary transfer belt are determined by the CPU.

Embodiment 7

Figure 15:
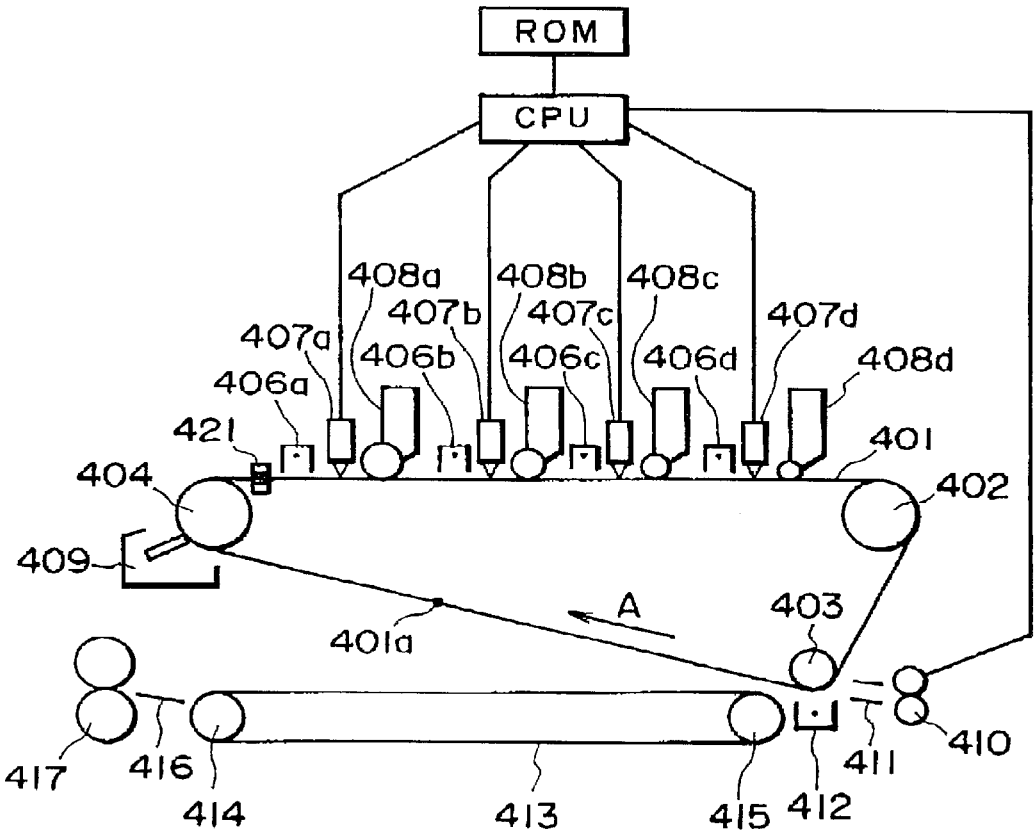
FIG. 15 is a schematic sectional view of the image forming apparatus in the seventh embodiment of the present invention.

Referring to FIG. 15, the description will be made as to this embodiment.

In this embodiment, the photosensitive belt 401 corresponds to the conveyer belt 100 shown in Embodiments 1–5.

In FIG. 15, the photosensitive belt 401 is stretched around the driving roller 402, follower rollers 403 and 404 and travels in the direction of arrow A.

Above the horizontal portion of the photosensitive belt 401, there are provided a corotron 406 for uniformly charging the surface of the photosensitive belt 401, a LED array 407 for writing the electrostatic latent image on the photosensitive belt 401 and developing stations for four colors each comprising a developing device 408 for visualizing the electrostatic latent images with toner.

The photo-sensor 421 disposed between the follower roller 404 and the corotron 406*a* corresponds to the photosensor 21 shown in FIG. 1, and it detects the slit 401*a* formed in the photosensitive belt 401 to recognize the reference position of the photosensitive belt 401 in the circumferential direction.

The photosensitive belt 401 is moved in the direction A by the driving roller 402, during which the different color toner images are sequentially superposed on the photosensitive belt 401.

Adjacent the follower roller 403, there is provided a pair of registration rollers 410, so that transfer sheet fed out of the sheet feeding cassette (unshown) is fed at a predetermined speed to the transfer point formed by the follower roller 403 and the transfer corotron 412 at a timed relation through between the guiding plates 411.

The toner images superposed on the photosensitive belt 401 are transferred onto the transfer sheet all together at the transfer point. The transfer sheet is fed by a transfer sheet conveyer belt 413 stretched around the driving roller 414 and the follower roller 415, and is guided by the guide 416 to a pair of fixing rollers 417.

The toner image of different colors transferred onto the upper is fixed on the transfer sheet into a full-color image by heat and pressure provided by the pair of fixing rollers 417.

The photosensitive belt 401 is cleaned by a cleaning blade 409 provided adjacent the follower roller 404 so that untransferred toner is scraped off the photosensitive belt 401, so that it is prepared for the next image formation.

In this embodiment, the description as to the speed profile relating to the thickness non-uniformity of the photosensitive belt 401, the adjustment values for the exposure start timing and the exposure time period. The fundamental concept is the same as with Embodiments 1–5, that is, the color misregistration and the color unevenness attributable to the travelling speed variation resulting from the non-uniformity of the thickness of the photosensitive belt 401, are minimized.

In this embodiment, in response to the detection signal provided by the passing of the slit 401*a* formed in the intermediary transfer belt, the feeding timing of the transfer material to the transfer portion and the positions of the image formations (development) on the photosensitive belt are determined by the CPU.

In said Embodiments 1–7, the photosensitive drum is exposed by LED, but this is not limiting, and the laser beam emitted from a laser beam generating apparatus may be used and is projected to the photosensitive drum through a polygonal mirror and a reflection mirror or the like.

Embodiment 8

Detailed description will be made as to inputting the thickness data of the belt when the belt is replaced due to lifetime of the belt or before the apparatus is shipped from the factory.

Figure 16:
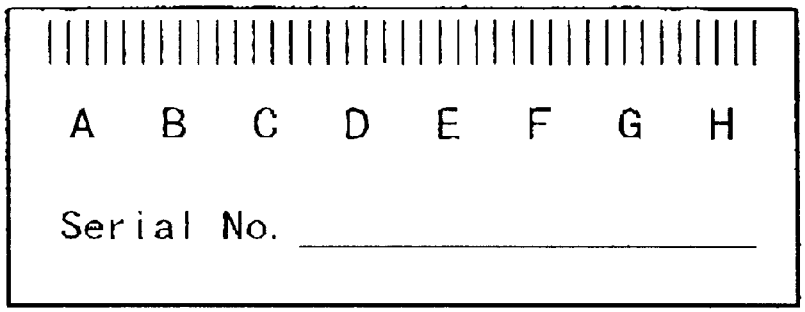
FIG. 16(*a*), is a drawing of a label on which the data regarding the thickness of a belt is recorded, and FIG. 16(*b*), is a drawing of the portion of a belt to which the label is attached.
Figure 16:
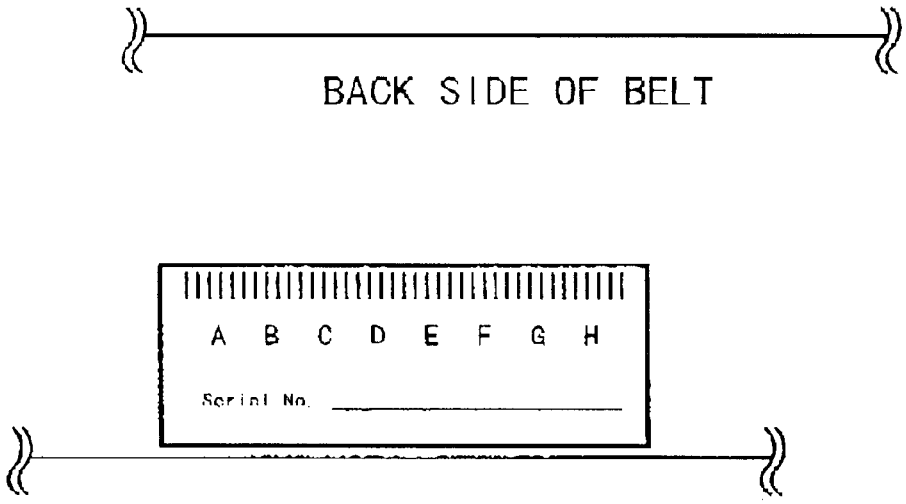
Figure 17:
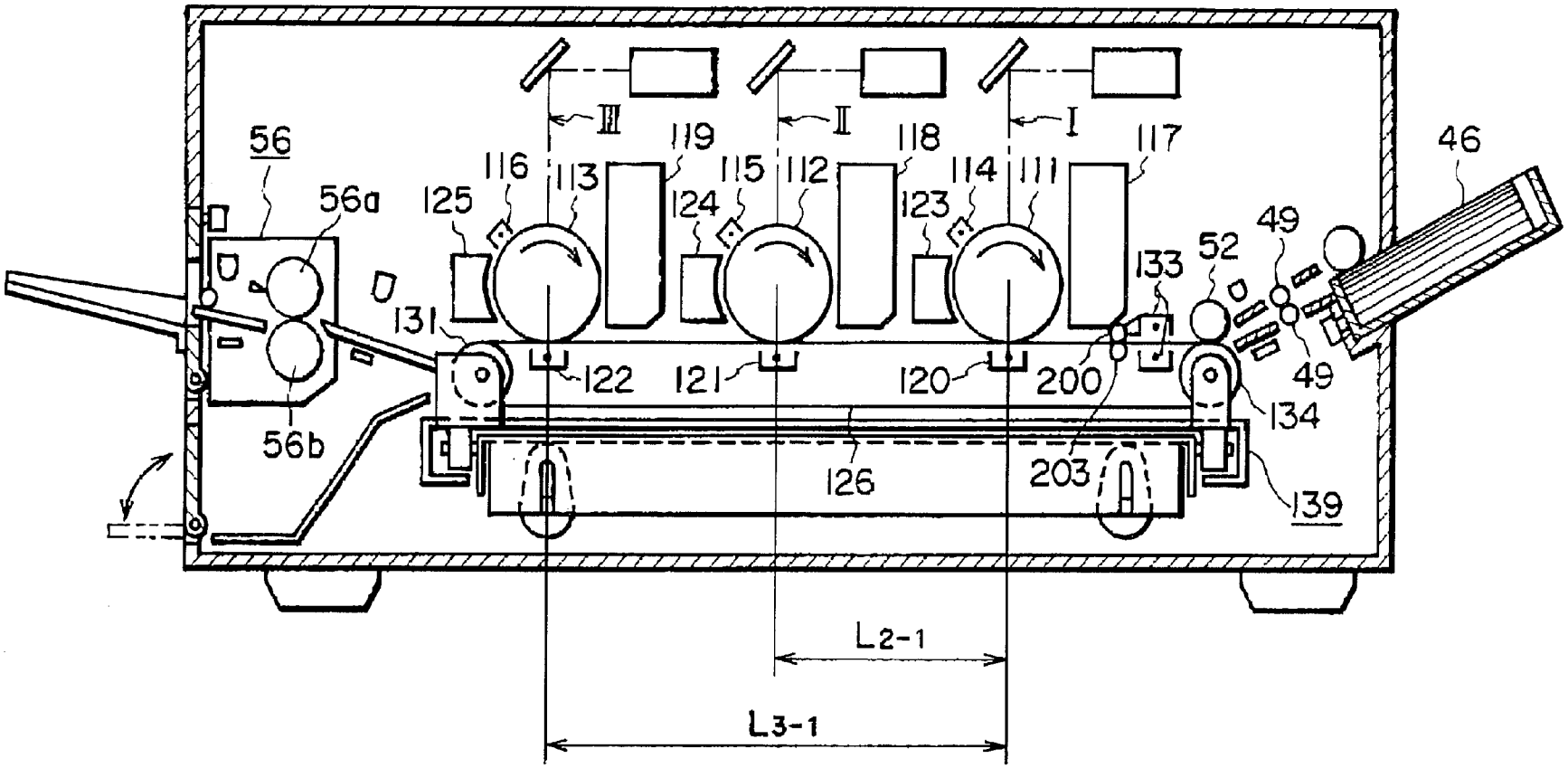
FIG. 17 is a schematic sectional view of a conventional image forming apparatus.
Figure 18:
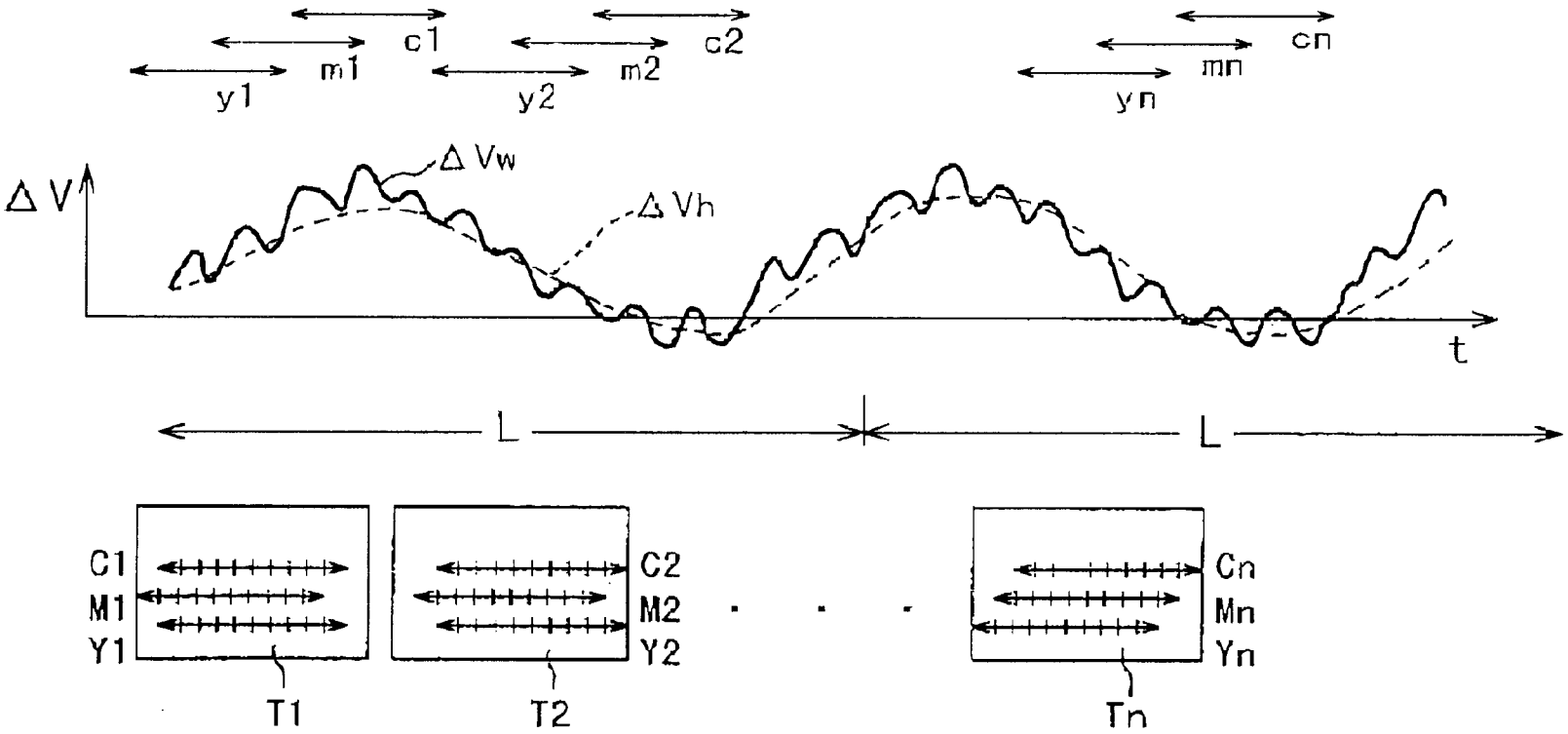
FIG. 18 is a schematic drawing which shows the state of color deviation in the color images formed by the conventional image forming apparatus.

A label having data A-H of the thickness of the belt as shown in FIG. 16(*a*) (8 data in this embodiment) is packed in the belt.

The user inputs the data on a liquid crystal display portion (inputting means) at the upper portion of the apparatus from the data to renew the data stored in the ROM. In this case, the data may be read in using a bar code reader so as to input the data through a cable connected with the apparatus.

As shown in FIG. 16(*b*), the data may be written on a back side of the belt (the side opposite from the side which carries the transfer material) at marginal portion (the portion not for carrying the transfer material) in a predetermined manner.

In addition, a serial number for identification of each belt is also written in.

In such a manner, the belt thickness data are inputted into the ROM to renew data, by which the color misregistration correction and control are effected by the CPU as in the foregoing Embodiments.

In order to effect the color misregistration correction and control in this embodiment, a memory medium storing the program codes over Software for renewing the thickness data is supplied to the image forming apparatus, and the computer of the image forming apparatus reads out the program codes stored in the memory medium, and the program is executed.

In this case, the program codes per se accomplishes the novel function of the present invention, and therefore, the memory medium storing the program codes constitutes the present invention.

The memory medium for supplying the problem codes may be, for example, floppy disk, hard disk, optical disk, magneto-optical disk, CD-ROM, CD-R, magnetic tape, non-volatile memory card, ROM, VDV or the like.

The present invention is not limited to the case in which the color misregistration correction and control are carried out by executing the program codes read out by the computer, but it covers the case in which a part or all of the actual process is carried out by the OS (operating system) running in the computer, and the functions of the foregoing Embodiments are carried out.

Moreover, the present invention covers the case in which the program codes read out of the memory medium are written in memory of a function expanding board inserted in the computer or in memory of a function extending unit connected with the computer, and then, the CPU provided in the function extending unit or the function expanding board carried out a part or all of the actual processing, by which the functions of the foregoing embodiments are accomplished. The program codes to be installed in the computer to execute the processing for the function of the present invention is covered by the present invention. In other words, the computer program per se for executing the function of the present invention is covered by the present invention.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a plurality of image beating members;

image forming means for forming images of different colors on said image bearing members, respectively;

a transfer material conveyer belt for carrying a transfer material;

a driving roller for transmitting a driving force to said transfer material conveyer belt;

wherein the images of different colors formed on said image bearing members are sequentially transferred in an overlying manner onto the transfer material carried on said transfer material conveyer belt;

storing means for storing information on thicknesses of said transfer material conveyer belt at different positions in a movement direction thereof;

detecting means for detecting a predetermined position of said transfer material conveyer belt; and control means for controlling timing of start of image formation for each of said image bearing members by associated one of said image forming means on the basis of the information stored in said storing means and a result of detection by said detecting means.

2. An apparatus according to claim 1, further comprising feeding means for feeding the transfer material to said transfer material conveyer belt, wherein said control means controls the timing of the start of the image formation on the basis of timing of the feeding of the transfer material of said feeding means.

3. An apparatus according to claim 1, wherein the information stored by said storing means is related to thicknesses of said transfer material conveyer belt at different positions in the movement direction thereof on the basis of a thickness at a reference position of said transfer material conveyer belt.

4. An apparatus according to claim 3, wherein said predetermined position and said reference position are remote from each other in the movement direction of said transfer material conveyer belt.

5. An apparatus according to claim 1, wherein the information stored in said storing means is information on the thickness at different positions of said transfer material conveyer belt on the basis of a thickness at said predetermined position.

6. An apparatus according to claim 5, wherein said control means controls timing of the start of the image formation on each of said image bearing member on the basis of the information.

7. An apparatus according to claim 1, further comprising a driving source for driving said driving rollers.

8. An apparatus according to claim 1, further comprising a roller for applying tension to said transfer material conveyer belt.

9. An apparatus according to claim 1 wherein said control means controls the timing of the start of the information on each of said image bearing member on the basis of at least two pieces of information among the information stored in said storing means to form the image on one transfer material.

10. An apparatus according to claim 1, wherein said control means controls a number of transfer materials which can be carried simultaneously on said transfer material conveyer belt in accordance with a length, measured in a movement direction of said transfer material conveyer belt, of the transfer material.

11. An apparatus according to claim 10, wherein a position on said transfer material conveyer belt at which the transfer material is carried, is substantially constant in accordance with the length, measured in a movement direction of said transfer material conveyer belt, of the transfer material.

12. An apparatus according to any one of claims 1–11, wherein said control means controls a length, measured in a movement direction of said image bearing member, of the image formed on each of said image bearing member, on the basis of the information stored in said storing means and a result of detection of said detecting means.

13. An apparatus according to claim 1–11, wherein said image forming means includes exposure means for forming a latent image by exposing surface of each of said image bearing members which has been electrically charged.

14. An apparatus according to claim 13, wherein said control means controls timing of start of the exposure of each of said image bearing member on the basis of the information stored in said storing means and a result of the detection of said detecting means.

15. An apparatus according to any one of claims 1–11, wherein said image forming means includes a plurality of exposure means for exposing said image bearing members, respectively, which have been electrically charged.

16. An apparatus according to claim 15, wherein said control means controls timing of start of exposure of each of the image bearing members by said exposure means on the basis of the information stored in said storing means and a result of detection of said detecting means.

17. An image forming apparatus comprising:

a plurality of image bearing members;

image forming means for forming images of different colors on said image bearing members, respectively;

a transfer material conveyer belt for carrying a transfer material;

a driving roller for transmitting a driving force to said transfer material conveyer belt;

wherein the images of different colors formed on said image bearing members are sequentially transferred in an overlying manner onto the transfer material carried on said transfer material conveyer belt;

storing means for storing information on thicknesses of said transfer material conveyer belt at different positions in a movement direction thereof;

detecting means for detecting a predetermined position of said transfer material conveyer belt; and control means for controlling a length, measured in a direction of movement of said image bearing member, of the image formed on each of said image bearing members by associated one of said image forming means on the basis of the information stored in said storing means and a result of detection by said detecting means.

18. An apparatus according to claim 17, further comprising feeding means for feeding the transfer material to said transfer material conveyer belt, wherein said control means controls said length on the basis of timing of the feeding of the transfer material of said feeding means.

19. An apparatus according to claim 17, wherein the information stored by said storing means is related to thicknesses of said transfer material conveyer belt at different positions in the movement direction thereof on the basis of a thickness at a reference position of said transfer material conveyer belt.

20. An apparatus according to claim 19, wherein said predetermined position and said reference position are remote from each other in the movement direction of said transfer material conveyer belt.

21. An apparatus according to claim 17, wherein the information stored in said storing means is information on the thickness at different positions of said transfer material conveyer belt on the basis of a thickness at said predetermined position.

22. An apparatus according to claim 21, wherein said control means controls said length on each of said image bearing member on the basis of the information.

23. An apparatus according to claim 17, further comprising a driving source for driving said driving roller.

24. An apparatus according to claim 17, further comprising a roller for applying tension to said transfer material conveyer belt.

25. An apparatus according to claim 17, wherein said control means controls the timing of the start of the information on each of said image bearing member on the basis of at least two pieces of information among the information stored in said storing means to form the image on one transfer material.

26. An apparatus according to claim 17, wherein said control means controls a number of transfer materials which can be carried simultaneously on said transfer material conveyer belt in accordance with a length, measured in a movement direction of said transfer material conveyer belt, of the transfer material.

27. An apparatus according to claim 26, wherein a position on said transfer material conveyer belt at which the transfer material is carried, is substantially constant in accordance with the length, measured in a movement direction of said transfer material conveyer belt, of the transfer material.

28. An apparatus according to claims 17–27, wherein said image forming means includes exposure means for forming a latent image by exposing a surface of each of said image bearing members which has been electrically charged.

29. An apparatus according to claim 28, wherein said control means controls the exposure time of each of said image bearing member on the basis of the information stored in said storing means and a result of the detection of said detecting means.

30. An apparatus according to any one of claims 17–27, wherein said image forming means includes a plurality of exposure means for exposing said image bearing members, respectively, which have been electrically charged.

31. An apparatus according to claim 30, wherein said control means controls timing of start of exposure of each of the image bearing members by said exposure means on the basis of the information stored in said storing means and a result of detection of said detecting means.

32. An image forming apparatus, comprising:

a belt;

a driving roller for transmitting a driving force to said belt;

image forming means for forming images of different colors on said belt;

wherein the images of different colors formed on said belt are transferred onto a transfer material;

storing means for storing information on thicknesses of said belt at different positions in a movement direction thereof;

detecting means for detecting a predetermined position of said belt; and control means for controlling timing of start of image formation on said belt by associated one of said image forming means on the basis of the information stored in said storing means and a result of detection by said detecting means.

33. An apparatus according to claim 32, wherein the information stored by said storing means is related to thicknesses of said belt at different positions in the movement direction thereof on the basis of a thickness at a reference position of said belt.

34. An apparatus according to claim 33, wherein said predetermined position and said reference position are remote from each other in the movement direction of said belt.

35. An apparatus according to claim 32, wherein the information stored in said storing means is information on the thickness at different positions of said belt on the basis of a thickness at said predetermined position.

36. An apparatus according to claim 35, wherein said control means controls timing of the start of the image formation on said belt on the basis of the information.

37. An apparatus according to claim 32, further comprising a driving source for driving said driving roller.

38. An apparatus according to claim 32, further comprising a roller for applying tension to said belt.

39. An apparatus according to claim 32, wherein said control means controls the timing of the start of the information on said belt on the basis of at least two pieces of information among the information stored in said storing means to form the image on one transfer material.

40. An apparatus according to claim 32, wherein said control means controls a number of transfer materials which can be carried simultaneously on said belt in accordance with a length, measured in a movement direction of said belt, of the transfer material.

41. An apparatus according to claim 40, wherein a position on said belt at which the transfer material is carried, is substantially constant in accordance with the length, measured in a movement direction of said belt, of the transfer material.

42. An apparatus according to claim 32, further comprising feeding means for feeding the transfer material to said belt, wherein said control means controls timing of start of the feeding on the basis of a result of detection by said detecting means.

43. An apparatus according to any one of claims 32–42, wherein said control means controls a length, measured in a movement direction of said belt, of the image formed on said belt, on the basis of the information stored in said storing means and a result of detection of said detecting means.

44. An apparatus according to any one of claims 32–42, wherein said image forming means includes a plurality of image hearing members for bearing the images of different colors, and exposure means for exposing said image bearing member electrically charged to form an electrostatic latent image, wherein the images of different colors are transferred onto said belt in an overlaying manner.

45. An apparatus according to claim 44, wherein said control means controls timing of start of the exposure of each of said image bearing member on the basis of the information stored in said storing means and a result of the detection of said detecting means.

46. An apparatus according to any one of claims 32–42, wherein said image forming means Includes a plurality of image bearing members for bearing the images, and a plurality of exposure means for exposing each of said image bearing members electrically charged to form electrostatic latent images, wherein the images of different colors are transferred onto said belt in an overlaying manner.

47. An apparatus according to claim 46, wherein said control means controls timing of start of exposure of each of the image bearing members by said exposure means on the basis of the information stored in said storing means and a result of detection of said detecting means.

48. An apparatus according to any one of claims 32–42, wherein said image forming means includes exposure means for forming a latent image by exposing a surface of said belt electrically charged, and a plurality of developing means for developing the images into images of different colors, respectively.

49. An apparatus according to claim 48, wherein said control means controls timing of start of the exposure of said belt on the basis of the information stored in said storing means and a result of the detection of said detecting means.

50. An apparatus according to claim 49, wherein said belt is a photosensitive member.

51. An apparatus according to any one of claims 32–42, wherein said image forming means includes a plurality of exposure means for forming latent images by exposing a surface of said belt electrically charged, and a plurality of developing means for developing the images into images of different colors, respectively.

52. An apparatus according to claim 51, wherein said control means controls timing of start of the exposure of said belt by each of said exposure means, on the basis of the information stored in said storing means and a result of the detection of said detecting means.

53. An apparatus according to claim 52, wherein said belt is a photosensitive member.

54. An image forming apparatus, comprising:

a belt;

a driving roller for transmitting a driving force to said belt;

image forming means for forming images of different colors on said belt;

wherein the images of different colors formed on said belt are transferred onto a transfer material;

storing means for storing information on thicknesses of said belt at different positions in a movement direction thereof;

detecting means for detecting a predetermined position of said belt; and control means for controlling a length of an image formed on said belt by said image forming means on the basis of the information stored in said storing means and a result of detection by said detecting means.

55. An apparatus according to claim 54, wherein the information stored by said storing means is related to thicknesses of said belt at different positions in the movement direction thereof on the basis of a thickness at a reference position of said belt.

56. An apparatus according to claim 55, wherein said predetermined position and said reference position are remote from each other in the movement direction of said belt.

57. An apparatus according to claim 54, wherein the information stored in said storing means is information on the thickness at different positions of said belt on the basis of a thickness at said predetermined position.

58. An apparatus according to claim 57, wherein said control means controls timing of the start of the image formation on said belt on the basis of the information.

59. An apparatus according to claim 54, further comprising a driving source for driving said driving roller.

60. An apparatus according to claim 54, further comprising a roller for applying tension to said belt.

61. An apparatus according to claim 54, wherein said control means controls the timing of the start of the information an said belt on the basis of at least two pieces of information among the information stored in said storing means to form the image on one transfer material.

62. An apparatus according to claim 54, wherein said control means controls a number of transfer materials which can be carried simultaneously on said belt in accordance with a length, measured in a movement direction of said belt, of the transfer material.

63. An apparatus according to claim 62, wherein a position on said belt at which the transfer material is carried, is substantially constant in accordance with the length, measured in a movement direction said belt, of the transfer material.

64. An apparatus according to claim 54, further comprising feeding means for feeding the transfer material to said belt, wherein said control means controls timing of start of the feeding on the basis of a result of detection by said detecting means.

65. An apparatus according to any one of claims 54–64, wherein said image forming means includes a plurality of image bearing members for bearing the images of different colors, and exposure means for exposing said image bearing member electrically charged to form an electrostatic latent image, wherein the images of different colors are transferred onto said belt in an overlaying manner.

66. An apparatus according to claim 65, wherein said control means controls timing of start of the exposure of each of said image bearing member on the basis of the information stored in said storing means and a result of the detection of said detecting means.

67. An apparatus according to any one of claims 54–64, wherein said image forming means includes a plurality of image bearing members for bearing the images of different colors, respectively, and a plurality of exposure means for exposing each of said image bearing members electrically charged to form electrostatic latent images, wherein the images of different colors are transferred onto said belt in an overlaying manner.

68. An apparatus according to claim 67, wherein said control means controls timing of start of exposure of each of the image bearing members by said exposure means on the basis of the information stored in said storing means and a result of detection of said detecting means.

69. An apparatus according to any one of claims 54–64, wherein said image forming means includes exposure means for forming a latent image by exposing a surface of said belt electrically charged, and a plurality of developing means for developing the images into images of different colors, respectively.

70. An apparatus according to claim 69, wherein said control means controls timing of start of the exposure of said belt on the basis of the information stored in said storing means and a result of the detection of said detecting means.

71. An apparatus according to claim 70, wherein said belt is a photosensitive member.

72. An apparatus according to any one of claims 54–64, wherein said image forming means includes a plurality of exposure means for forming latent images by exposing a surface of said belt electrically charged, and a plurality of developing means for developing the images into images of different colors, respectively.

73. An apparatus according to claim 72, wherein said control means controls timing of start of the exposure of said belt by each of said exposure means, on the basis of the information stored in said storing means and a result of the detection of said detecting means.

74. An apparatus according to claim 73, wherein said belt is a photosensitive member.

75. A belt for one of carrying an image or for carrying a transfer material on which an image is formed, wherein information on a thickness of said belt at different positions in a moving direction thereof is displayed on the surface of the belt, the information based on measurements made before assembling said belt in an image forming apparatus.

76. A belt according to claim 75, wherein the information is provided at a position outside areas on which an image is formed or outside areas on which the transfer material is carried.

77. A method of updating belt thickness information at different positions in a moving direction of the belt, comprising:

a step of inputting the belt thickness information;

a step of updating the belt thickness information from information stored in memory into information inputted by said inputting step;

a step of controlling timing of formation of the image on the belt or on a transfer material carried on the belt by a control in accordance with the information stored in said memory.

78. A method according to claim 77, wherein said control step controls a length of the image formed on said belt or on the transfer material carried on said belt on the basis of the information stored in said memory.

79. A method according to claim 78, therein the information is inputted by inputting means.

80. A machine readable media containing a program executable by a computer, for updating belt thickness information at different positions in a moving direction of the belt, said program comprising:

program codes for inputting the belt thickness information;

program codes for updating the belt thickness information from information stored in memory into information inputted by said inputting step;

program codes for controlling timing of formation of the image on a belt or on a transfer material carried on the belt by a control in accordance with the information stored in said memory.

81. A program according to claim 80, further comprising a program code for controlling a length of the image formed on said belt or on the transfer material carried on said belt on the basis of the information stored in said memory.

* * * * *

UNITED STATES PATENT AND TRADEMARK OFFICE

CERTIFICATE OF CORRECTION

PATENT NO. : 6,330,404 B1
DATED : December 11, 2001
INVENTOR(S) : Katsumi Munenaka et al.

It is certified that error appears in the above-identified patent and that said Letters Patent is hereby corrected as shown below:

Column 3,
Line 24, "wintered" should read -- sintered --.

Column 8,
Line 37, "give" should read -- given --.

Column 9,
Line 30, "correction." should read -- correction, --.
Line 48, "siib-scan" should read -- sub-scan --.

Column 10,
Line 3, "transferer" should read -- transfer --.

Column 11,
Line 6, "images. The" should read -- images, the --.
Line 50, "example." should read -- example, --.
Line 54, "embodiment. The" should read -- embodiment, the --.

Column 12,
Line 48, "thickness thickness" should read -- thickness --.

Column 13,
Line 15, "belt then," should read -- belt. Then, --.

Column 14,
Line 62, "PC" should read -- Pc --.

Column 15,
Line 11, "emitted" should read -- omitted --.
Line 26, "predetermining" should read -- predetermined --.
Line 35, "ta4-ta4" should read -- ta4-td4 --.

Column 18,
Line 29, "Software" should read -- software --.

Column 19,
Line 47, "member" should read -- members --.
Line 50, "rollers." should read -- roller. --.
Line 56, "member" should read -- members --.

UNITED STATES PATENT AND TRADEMARK OFFICE

CERTIFICATE OF CORRECTION

PATENT NO. : 6,330,404 B1
DATED : December 11, 2001
INVENTOR(S) : Katsumi Munenaka et al.

It is certified that error appears in the above-identified patent and that said Letters Patent is hereby corrected as shown below:

Column 20,
Lines 6 and 7, "member," should read -- members, --.
Line 12, "surface" should read -- a surface --.
Line 16, "member" should read -- members --.

Column 21,
Line 37, "member" should read -- members --.

Column 22,
Line 59, "Includes" should read -- includes --.

Signed and Sealed this

Seventh Day of May, 2002

*Attest:*

*Attesting Officer*

JAMES E. ROGAN
*Director of the United States Patent and Trademark Office*